United States Patent [19]

Ikeda et al.

[11] Patent Number: 4,806,461

[45] Date of Patent: Feb. 21, 1989

[54] SILVER HALIDE EMULSION AND PHOTOGRAPHIC LIGHT-SENSITIVE MATERIAL USING TABULAR GRAINS HAVING TEN OR MORE DISLOCATIONS PER GRAIN

[75] Inventors: Hideo Ikeda; Munehisa Fujita; Shingo Ishimaru; Hiroshi Ayato; Shigeharu Urabe, all of Minami-Ashigara, Japan

[73] Assignee: Fuji Photo Film Co., Ltd., Minami-Ashigara, Japan

[21] Appl. No.: 165,085

[22] Filed: Mar. 7, 1988

[30] Foreign Application Priority Data

Mar. 10, 1987 [JP] Japan ..... 61-54640

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,353,977 | 10/1982 | Gerber et al. | 430/567 |
| 4,414,306 | 11/1983 | Wey et al. | 430/434 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,451,560 | 5/1984 | Gerber et al. | 430/567 |
| 4,459,353 | 7/1984 | Maskasky | 430/434 |
| 4,665,012 | 5/1987 | Sugimoto et al. | 430/567 |
| 4,684,607 | 8/1987 | Maskasky | 430/567 |

OTHER PUBLICATIONS

Photographic Science and Engineering, vol. 8, Nov./-Dec. 1964, pp. 346–352.

Journal of Imaging Science, vol. 31, No. 1, Jan./Feb. 1987, pp. 15–26, SPSE.

T. H. James: "Theory of the Photographic Process", 4th Ed., 1077, Section II.F, Dislocations, pp. 19–21, Macmillan Publ.

*Primary Examiner*—Mukund J. Shah

*Attorney, Agent, or Firm*—Burns, Doane, Swecker & Mathis

[57] ABSTRACT

A silver halide emulsion comprises a dispersion medium and silver halide grains, the silver halide emulsion containing tabular silver halide grains having a thickness of less than 0.5 μm, a diameter of 0.3 μm or more, and a mean diameter-to-thickness ratio of 2 or more. The tabular grains occupy at least 50% of a projected area of all the silver halide grains, and 50% or more (number) of the tabular grains include 10 or more dislocations per grain. A photographic light-sensitive material comprises the aforementioned silver halide emulsion.

4 Claims, 3 Drawing Sheets

SILVER HALIDE EMULSION AND PHOTOGRAPHIC LIGHT-SENSITIVE MATERIAL USING TABULAR GRAINS HAVING TEN OR MORE DISLOCATIONS PER GRAIN

BACKGROUND OF THE INVENTION

1. Field of the Invention

The present invention relates to a silver halide photographic light-sensitive material and, more particularly, to a photographic light-sensitive material having improved photographic characteristics and storage properties and containing an emulsion containing tabular silver halide grains.

2. Description of the related art including information disclosed under 1.97–1.99:

Methods of forming and techniques of utilizing tabular silver halide grains are already disclosed in, for example, U.S. Pat. Nos. 4,434,226, 4,439,520, 4,414,310, 4,433,048, 4,414,306, and 4,459,353 and Japanese Patent Application (OPI) Nos. 59-99433 and 62-209445. The tabular silver halide grains have advantages such as improvements in sensitivity including an improvement in spectral sensitization efficiency obtained by a sensitizing dye, an improvement in a sensitivity/graininess relationship, an improvement in sharpness obtained by unique characteristics of the tabular grains, an improvement in covering powder, and the like.

However, a strong demand has arisen for a more advantageous photographic silver halide emulsion. That is, in addition to photographic characteristics such as sensitivity, and image quality such as graininess and sharpness, a higher level demand has arisen for so-called toughness such as an exposure intensity dependency, storage stability, and resistance to pressure. Conventional silver halide grains do not completely satisfy the above demand. Japanese Patent Application (OPI) No. 59-99433 discloses a technique for improving resistance to pressure of a light-sensitive material containing tabular silver halide grains having a grain diameter/thickness ratio of 5 or more. However, in this technique, exposure intensity dependency and storage stability of photographic characteristics cannot be completely improved.

This invention relates to a technique for controlling formation of dislocations in tabular silver halide grains. Dislocations of the silver halide grains are described in, for example, (1) C. R. Berry, J. Appl. Phys., 27, 636 (1956), (2) C. R. Berry, D. C. Skillman, J. Appl. Phys., 35, 2165 (1964), (3) J. F. Hamilton, Phot. Sci. Eng., 11, 57, (1967), (4) T. Shiozawa, J. Soc. Phot. Sci Japan, 34, 16, (1971), and (5) T. Shiozawa, J. Soc. Phot. Sci Japan, 35, 213 (1972). (1) to (4) describe that dislocations in grains can be observed by an X-ray diffraction method or can be observed directly by a transmission electron microscope at a low temperature and that a variety of dislocations can be generated in grains by intentionally applying stress to the grains. However, (1) to (4) do not describe that the technique for controlling formation of dislocations in tabular silver halide grains during a formation process of the grains is important to toughness as described above. (5) describes that dislocations can be observed in most of unsensitized tabular silver halide grains having a composition AgBrI (I=1 mol%) and a grain diameter/thickness ratio of 75 by a transmission electron microscope at a low temperature. However, (5) describes only observation of the individual grains but does not refer to a relationship between dislocation and the photographic characteristics at all. That is, overall photographic characteristics, of the grains, as an emulsion containing a large number of tabular silver halide grains having dislocations, are not examined at all.

SUMMARY OF THE INVENTION

It is, therefore, an object of the present invention to provide a silver halide emulsion having high sensitivity, good graininess, sharpness, and resistance to pressure and improved exposure intensity dependency and storage stability, and a photographic light-sensitive material using the same.

As a result of extensive studies, the present inventors found that the above object of this invention can be achieved by:

(1) A silver halide emulsion comprising a dispersion medium and silver halide grains, the silver halide emulsion containing tabular silver halide grains having a thickness of less than 0.5 μm, a diameter of 0.3 μm or more, and a mean diameter-to-thickness ratio of 2 or more, wherein the tabular grains occupy at least 50% of a projected area of all the silver halide grains, and 50% (number) or more of the silver halide grains include 10 or more dislocations per grain.

(2) A silver halide emulsion comprising a dispersion medium and silver halide grains, the silver halide emulsion containing tabular silver halide grains having a thickness of 0.5 μm or less, a diameter of 0.3 μm or more, and a mean diameter-to-thickness ratio of 2 or more, wherein the tabular grains occupy at least 50% of a projected area of all the silver halide grains, 50% (number) or more of the silver halide grains include 10 or more dislocations per grain, and the tabular grain has a inner region portion having a silver iodide content larger than that of a surface region of the tabular grain.

(3) A silver halide photographic light-sensitive material comprising a support having thereon at least one silver halide emulsion layer, wherein the emulsion layer contains emulsion described in (1) or (2).

In this invention, tabular silver halide grains (to be referred to as "tabular grains") have two opposing parallel major faces whose diameter (diameter of a circle having the same area as the projected area of the major faces) is twice or more a distance (i.e., a thickness of a grain) between the major faces.

A mean grain diameter/thickness ratio of the tabular grains according to this invention in emulsion is preferably 3 to 12, and more preferably, 5 to 10.

A mean grain diameter/thickness ratio can be obtained by averaging grain diameter/thickness ratios of all the tabular grains. However, this can be obtained more easily as a ratio of a mean diameter to a mean thickness of all the tabular grains.

A diameter of the tabular grains in this invention (diameter of a circle having the same area as the projected area of the tabular grains) is 0.3 to 10 μm, preferably, 0.5 to 5.0 μm, and more preferably, 0.5 to 2.0 μm. A grain thickness is 0.5 μm or less, preferably, 0.05 to 0.5 μm, and more preferably, 0.08 to 0.3 μm.

Diameter and thickness of grains in this invention can be measured by an electron microscopic photograph of grains as described in U.S. Pat. No. 4,434,226. A halide composition of the tabular grains is preferably silver iodobromide or silver iodochlorobromide, and more preferably, silver iodobromide having a silver iodide content of 0.1 to 20 mol%, preferably 1 to 10 mol%.

Dislocations of the tabular grains can be observed directly by a transmission electron microscope at a low temperature as described in J. F. Hamilton, Phot. Sci. Eng., 11, 57, (1967) and T. Shiozawa, J. Soc. Phot. Sci Japan, 35, 213, (1972). That is, a silver halide grain carefully picked up from an emulsion so that a pressure capable of generating dislocations in the grain is not applied thereto is placed on a mesh for electron microscopic observation. Then, the sample is cooled to prevent damage (e.g., print out) by electron beam and observed by transmission method. In this case, since it is difficult for a thick grain to transmit electron beam, the grain can be observed more clearly by an electron microscope of a high voltage type (200 KV or more with respect to a grain having a thickness of 0.25 $\mu$). Using photographs of grains obtained in this manner, the positions and number of dislocations of each grain, viewed from a direction perpendicular to the major face, can be determined.

Dislocations of the tabular grains of this invention are generated in a major axis direction of the tabular grains from a position away from the center by a distance which is x% of a length between the center and an edge, to the edge. A value of x is preferably $10 \leqq x < 100$, more preferably, $30 \leqq x < 98$, and most preferably, $50 \leqq x < 95$. At this time, a shape obtained by connecting positions at which dislocations start is close to a similar figure of the grain but is not always a complete similar figure, i.e., distorted. Dislocation lines extend substantially from the center to the edge but sometimes extend in a zig-zag manner.

In this invention, grains including 10 or more dislocations preferably exist in all the tabular grains in a percentage ratio of 50% (number) or more of all the tabular grains. More specifically, grains including 10 or more dislocations preferably exist in a percentage ratio of 80% (number) or more, and more specifically, grains including 20 or more dislocations preferably exist in a percentage ratio of 80% (number) or more.

A structure of a halide composition of the tabular grains can be checked using a combination of X-ray diffraction, an EPMA (also called as an XMA) method (of scanning silver halide grains by electron beam to detect the silver halide composition), an ESCA (also called as an XPS) method (of radiating X-rays to perform spectral analysis of photoelectrons emitted from the surface of grains), and the like.

In this invention, surface region of a grain is a region extending from the surface to a depth of about 50 Å. A halide composition of such a region can be measured by the ESCA method. An inner region of a grain is a region other than the above surface region.

A method for preparing tabular grains will be described below.

The tabular grains can be formed using a proper combination of methods known to those skilled in the art.

For example, a seed crystal in which tabular grains exist in an amount of 40 wt% is formed in an atmosphere having a relatively high pAg value with a pBr of 1.3 or less. Then, solution of silver ion and solution of halide ion are added to the seed crystal while maintaining the above pBr value or more to grow the seed crystal, thereby forming tabular grains.

In a grain growth process performed by adding silver and/or halide, preferably, solution of silver and solution of halide are carefully added to the seed crystal so that a new crystal nucleus is not generated.

A size of the tabular grains can be adjusted by controlling a temperature, selecting a type and an amount of a solvent, and controlling an addition speed of a silver salt and a halide used in the grain growth process.

Dislocations in the tabular grains of this invention can be controlled by providing specific iodide rich phases in internal portion of the grains. More specifically, substrate grains are prepared, iodide rich phases are formed by method (1) or (2) to be described below, and the iodide rich phases are covered with phases having an iodide content lower than that of the iodide rich phases, thereby obtaining dislocations.

The iodide content of the tabular substrate grains is lower than that of the rich iodide phases, preferably, 0 to 12 mol%, and more preferably, 0 to 10 mol%.

Internal iodide rich phases mean a silver halide solid soultion containing iodide. In this case, silver iodide, silver iodobromide, or silver iodochlorobromide is preferred as the silver halide. Silver iodide or silver iodobromide (iodide content: 10 to 40 mol%) is more preferable, and silver iodide is especially preferable.

It is important that the internal iodide rich phases are deposited not uniformly but locally on faces of substrate grains. Such localization may be performed on any of a major face, a side face, an edge, and a corner. In addition, this localization may be selectively epitaxially coordinated in the above portions.

(1) For this purpose, a so-called conversion method described in E. Klein, E. Moisar, G. Murch, Phot. Korr., 102, (4), 59 to 63, (1966) may be used. In this method, during a grain formation process, halide ions having a lower silver salt solubility than that of silver halide which form a grain (or a portion close to the surface of the grain) at this time are added. In this invention, an amount of the halide ions having a lower silver salt solubility to be added is preferably larger than a value (associated with a halide composition) with respect to a surface area of the grain at this time. For example, during grain formation, KI is preferably added in an amount larger than a certain value with respect to a surface area of an AgBr grain at this time. More specifically, KI is preferably added in an amount of $8.2 \times 10^{-5}$ mol/m$^2$ or more.

(2) In addition, an epitaxial junction method as described in, for example, Japanese Patent Application (OPI) Nos. 59-133540, 58-108526, and 59-162540 can be used. In this method, site directors of epitaxial growth such as an absorptive spectral sensitizing dye can be used. By adding the site directors or by selecting conditions (e.g., a pAg, pH, and temperature) for crystal growth and adding solution of silver salt and solution of halide solution containing an iodide ion, thereby forming the internal iodide rich phases of this invention.

In order to practice the above two methods, solubility of a silver halide in a mixture system is preferably as low as possible. This is because solubility in the system affects distribution of the iodide rich phases on the surface (if the solubility is high, the phases tend to be uniformly distributed).

When the internal iodide rich phases are to be formed, a pAg of the mixture system preferably falls within the range of 6.4 to 10.5, and more preferably, 7.1 to 10.2.

External phases covering the iodide rich phases have an iodide content lower than that of the iodide rich phases. More specifically, the iodide content of the external phases is preferably 0 to 12 mol%, more preferably, 0 to 10 mol%, and most preferably, 0 to 3 mol%.

The internal iodide rich phases preferably exist in the major axis direction of the tabular grain within the range of 5 to 80 mol% preferably 10 to 70 mol%, and more preferably, 20 to 60 mol% in terms of a silver content of the entire grain.

In this case, the major axis direction of a grain means a diameter direction of the tabular grains, and a minor axis direction means a thickness direction thereof.

The iodide content of the internal iodide rich phases is higher than a mean iodide content of silver bromide, silver iodobromide, or silver iodochlorobromide present on the grain surface. The iodide content of the internal iodide rich phases is preferably 5 times or more, and more preferably, 20 times or more or the mean iodide content of the grain surface.

A content of the silver halide which forms the internal iodide rich phases is 50 mol% or less, preferably 10 mol% or less, and more preferably, 5 mol% or less in terms of a silver content of the entire grain.

In this invention, the following mono-dispersion hexagonal tabular grains can be used.

This emulsion is a silver halide emulsion consisting of a dispersion medium and silver halide grains. In this emulsion, 70% or more of the entire projected area of the silver halide grains is occupied by tabular silver halide grains which are hexagons in which a ratio of a length of an edge having a maximum length to a length of an edge having a minimum length is 2 or less and which have two parallel faces as outer surfaces. This emulsion is a mono-dispersion emulsion, i.e., a variation coefficient of a grain size distribution of the hexagonal tabular silver halide grains is 20% or less. The variation coefficient is a value obtained by dividing a variation (standard deviation) of a grain size, which is represented by a diameter of a circle having the same area as the projected area of the grains, by the average grain size. An aspect ratio is 2.5 or more, and a grain size is 0.2 μm or more.

A composition of the hexagonal tabular grains may be any of silver bromide, silver iodobromibe, silver chlorobromide, and silver iodochlorobromide. If iodide ions are contained, its content is 0 to 30 mol%. A crystal structure may be any of a uniform structure, a structure whose inner portion consists of a halide composition different from that of an outer portion, and a layer structure. A reduction sensitized silver nucleus is preferably contained in the grains.

The silver halide grains can be manufactured through nucleus formation, Ostwald ripening, and grain growth.

During manufacture of the tabular grains of this invention, a method of increasing an addition speed, an addition amount, and an addition concentration of a salt of silver solution (e.g., an aqueous $AgNO_3$ solution) and a halide solution (e.g., an aqueous KBr solution) to be added to accelerate grain growth is preferably used.

Examples of this method are described in British Pat. No. 1,335,925, U.S. Pat. Nos. 3,672,900, 3,650,757, and 4,242,445, and Japanese Patent Application (OPI) Nos. 55-142329 and 55-158124.

A solvent for silver halide is effective to promote ripening. For example, in order to promote ripening, an excessive amount of halide ions is supplied into a reaction vessel. Therefore, it is obvious that ripening can be promoted by only supplying a solution of salt of halide into the reaction vessel. Other ripening agents may also be used. These ripening agents may be entirely mixed in a dispersion medium in the reaction vessel before the salt of silver and the salt of halide are added or may be supplied into the reaction vessel together with 1 or more salts of halides, salts of silver, or deflocculating agents. As another modification, the ripening agents may be independently supplied when a salt of halide and salt of silver are added.

Examples of the ripening agent other than halide ions are ammonia, amine compound, thiocyanate such as alkaline metal thiocyanate, especially sodium or potassium thiocyanate, and ammonium thiocyanate. Methods of using thiocyanate ripening agent are described in U.S. Pat. Nos. 2,222,264, 2,448,534, and 3,320,069. A conventional thioether ripening agent can be used as described in U.S. Pat. Nos. 3,271,157, 3,574,628, and 3,737,313. A thionic compound as disclosed in Japanese Patent Application (OPI) Nos. 53-82408 and 53-144319 can also be used.

By supplying a variety of compounds during process of forming silver halide precipitation, characteristics of the silver halide grains can be controlled. Such compounds may be initially supplied in the reaction vessel or may be added together with 1 or more of salts in accordance with a conventional method. As desribed in U.S. Pat. Nos. 2,448,060, 2,628,167, 3,737,313, and 3,772,031 and Research Disclosure, Vol. 134, No. 13452 (June 1975), compounds of copper, iridium, lead, bismuth, cadmium, zinc, (a chalcogenide of sulfur, selenium, tellurium or the like), and compounds of gold, and noble metals of Group VII may be supplied during process of forming in the silver halide precipitation to control the characteristics of the silver halide. As described in Japanese Patent Publication No. 58-1410 and Moisar et al., Journal of Photographic Science, Vol. 25, 19–27 (1977), the interiors of the grains of the silver halide emulsion can be subjected to reduction sensitization in the process of forming precipitation.

In the tabular grains used in this invention, silver halides having different compositions may be bonded to each other by an epitaxial junction or a silver halide may be bonded to a compound other than silver halides, such as silver rhodanide or lead oxide. These emulsion grains are disclosed in, for example, U.S. Pat. Nos. 4,094,684, 4,142,900, and 4,459,353, British Pat. No. 2,038,792, U.S. Pat. Nos. 4,349,622, 4,395,478, 4,433,501, 4,463,087, 3,656,962, and 3,852,067, and Japanese Patent Application (OPI) No. 59-162540.

Normally, the tabular grains of this invention are chemically sensitized.

As described in T. H. James, The Theory of the Photographic Process, 4th ed., Macmillan (1977), 67–76, chemical sensitization can be performed by using active gelatin. Chemical sensitization can also be performed by using sulfur, selenium, tellurium, gold, platinum, palladium, and iridium or a combination of a plurality of these sensitizing agents in an atmosphere in which a pAg is 5 to 10, a pH is 5 to 8 and a temperature is 30° to 80° C. as described in Research Disclosure, Vol. 120, No. 12008 (April 1974); Research Disclosure, Vol. 34, No. 13452 (June 1975), U.S. Pat. Nos. 2,642,361, 3,297,446, 3,772,031, 3,857,711, 3,901,714, 4,266,018, and 3,904,415, and British Pat. No. 1,315,755. Chemical sensitization is optimally performed in the presence of gold and thiocyanate compounds, or in the presence of sulfur-containing compounds described in U.S. Pat. Nos. 3,857,711, 4,266,018, and 4,054,457 or a sulfur-containing compound such as hypo, a thiourea series compound, or a rhodanic series compound. Chemical sensitization can be performed also in the presence of a chemical sensitizing aid. An example of a chemical sensitizing aid is a compound such as azaindene, azapyridazine, or azapyrimidine which is known to reduce a fog and increase sensitivity in a chemical sensitizing process. Examples of a chemical sensitization modifirers are described in U.S. Pat. Nos. 2,131,038, 3,411,914, and 3,554,757, Japanese Patent Application (OPI) No. 58-126526, and G. F. Duffin, Photographic Emulsion Chemistry, 138–143. In addition to or in place of chemical sensitization, reduction sensitization can be performed using hydrogen as described in U.S. Pat. Nos. 3,891,446 and 3,984,249, using stannous chloride, thiourea dioxide, polyamine and such a reducing agent as described in U.S. Pat. Nos. 2,518,698, 2,743,182, and 2,743,183, or by a low pAg (e.g., less than 5) and/or high pH (e.g., more than 8) treatment. Spectral sensitization can be improved by chemical sensitization methods described in U.S. Pat. Nos. 3,917,485 and 3,966,476.

Furthermore, a sensitization method using an oxidizing agent described in Japanese Patent Application (OPI) No. 61-3134 or 61-3136 can also be used.

The emulsion containing tabular grains of this invention can be used together with an emulsion containing silver halide grains (to be referred to as non-tabular grains hereinafter) which are subjected to normal chemical sensitization, in a single silver halide emulsion layer. Especially in a color photographic light-sensitive material, the tabular grain and non-tabular grain emulsions can be used in different emulsion layers and/or the same emulsion layer. Examples of the non-tabular grains are regular grains having a regular crystal form such as cube, octahedron, tetradecahedron, and an irregular crystal form such as sphere, potato-like. Silver bromide, silver iodobromide, silver iodochlorobromide, silver chlorobromide, or silver chloride can be used as a silver halide in the non-tabular grains. A preferred silver halide is silver iodobromide or silver iodochlorobromide containing at most about 30 mol% of silver iodide. A particularly preferred silver halide is silver iodobromide containing about 2% to about 25% of silver iodide.

The non-tabular grains may be fine grains having grain sizes (diameters) of not more than about 0.1 micron. They may be large grains as long as the diameter of their projected areas does not exceed 10 microns or thereabouts. Also, the silver halide emulsion for use in this invention may be a mono-dispersed silver halide emulsion having a narrow grain size distribution or a poly-dispersed silver halide emulsion having a broad grain distribution.

The non-tabular grains for use in this invention can be prepared using the methods described, for example, in P. Glafkides, Chimie et Physique Photographique Paul Montel, published by Paul Montel, 1967; G. F. Duffin, Photographic Emulsion Chemistry, published by Focal Press, 1966; and V. L. Zelikman et al., Making and Coating Photographic Emulsion, published by Focal Press, 1964. That is, the photographic emulsion may be prepared by an acid method, a neutralization method, an ammonia method, etc. Also, as a system for reacting a soluble silver salt and a soluble halide, a single jet method, a double jet method, or a combination thereof may be used. Also, a so-called back mixing method for forming silver halide grains in the existence of excessive silver ions can be used. As one system of the double jet method, a so-called controlled double jet method wherein the pAg in the liquid phase of forming silver halide is kept at a constant value can be used. According to this method, a silver halide emulsion having a regular crystal form and almost uniform grain sizes is obtained.

Two or more kinds of silver halide emulsions separately prepared can be used as a mixture thereof.

The silver halide emulsion containing the above-described regular silver halide grains can be obtained by controlling the pAg and pH during the formation of the silver halide grains. More particularly, such a method is described in Photographic Science and Engineering, Vol. 6, 159–165 (1962); Journal of Photographic Science, Vol. 12, 242–251 (1964); U.S. Pat. No. 3,655,394, and British Pat. No. 1,413,748.

Mono-dispersed emulsions are described in Japanese patent application (OPI) Nos. 48-8600, 51-39027, 51-83097, 53-137133, 54-48521, 54-99419, 58-37635, and 58-49938, Japanese Patent Publication No. 47-11386, U.S. Pat. No. 3,655,394, and British Pat. No. 1,413,748.

As to the crystal structure of the silver halide for use in this invention, the non-tabular grains may be uniform, may have a different halide composition between the inside and the outside thereof, or may have a layer structure. These emulsion grains are disclosed in British Pat. No. 1,027,146, U.S. Pat. Nos. 3,505,068 and 4,444,877, and Japanese patent application (OPI) No. 58-248469.

In this invention, a non-light-sensitive fine grain emulsion containing grains having a grain size of at most 0.6μ, and preferably, at most 0.2μ may be added to a silver halide emulsion layer, an interlayer, or a protective layer for the purpose of promoting development, improving storage stability, effectively utilizing reflected light, and the like.

The tabular grains of this invention are preferably used in a color light-sensitive material for photographing.

When the tabular grain emulsion of this invention is used together with, especially, a non-tabular mono-dispersed silver halide grain emulsion in a single emulsion layer and/or different emulsion layers, sharpness and graininess can be improved at the same time.

In this case, the mono-dispersed silver halide emulsion (non-tabular grain) is defined such that 95% or more of a total weight or a total number of silver halide grains contained in the emulsion have grain sizes falling within the range of ±40%, and preferably, ±30% of a mean grain size. As described in Japanese Patent Publication No. 47-11386, Japanese patent application (OPI) Nos. 55-142329, 57-17235, and 59-72440, graininess can be improved by using the mono-dispersed silver halide emulsion in the silver halide photographic light-sensitive material. As described in T. H. James, The Theory of the Photographic Process, 580–585, mono-dispersed silver halide grains having sizes of 0.3 to 0.8μ have a high light scattering property with respect to light of a specific wavelength range but have a relatively low light scattering property with respect to light of other wavelength ranges.

Therefore, when the tabular silver halide emulsion having a grain diameter/thickness ratio of 2 or more and the mono-dispersed silver halide emulsion are properly arranged in consideration of the optical characteristics and graininess of both the emulsions, sharpness and graininess of the silver halide photographic light-sensitive material can be improved at the same time.

Some examples of a light-sensitive material using tabular and mono-dispersed silver halide emulsions will be described below.

Example (1) In a light-sensitive material in which red-sensitive, green-sensitive, and blue-sensitive layers are arranged in the order named from a support, if a mean grain size of silver halide grains contained in a silver halide emulsion layer constituting the blue-sensitive layer falls within the range of 0.3 to 0.8μ, the tabular grain emulsion is used as the emulsion layer, and if the mean grain diameter does not fall within the above range, the mono-dispersed silver halide emulsion is used. As a result, sharpness of the green- and red-sensitive layers and graininess of the blue-sensitive layer can be improved.

Example (2) In a light-sensitive material having a layer arrangement similar to that of Example 1, if a mean grain size of silver halide grains contained in a silver halide emulsion layer constituting the green-sensitive layer falls within the range of 0.4 to 0.8μ, the tabular grain emulsion is used as the emulsion layer, and if the mean grain size does not fall within the above range, the mono-dispersed emulsion is used. As a result, sharpness of the red-sensitive layer and graininess of the green-sensitive layer can be improved at the same time.

Example (3) In a light-sensitive material having a layer arrangement similar to that of Example 1 in which emulsion layers having the same color sensitivity consist of two or more layers having different sensitivities or speeds, if silver halide grains contained in the blue-sensitive layer having highest sensitivity are mono-dispersed silver halide grains (preferably, double structure grains) having a mean grain size of 1.0μ or more and light scattering of a blue-sensitive layer having lower sensitivity is large, the tabular grain emulsion is used as the blue-sensitive layer having lower sensitivity. As a result, sharpness of the green- and red-sensitive layers can be improved.

Example (4) In a light-sensitive material having a layer arrangement similar to that of Example 3, if all of a plurality of green-sensitive layers have large light scattering, the tabular grain emulsion is used as all the green-sensitive layers. As a result, sharpness of the red-sensitive layers and graininess of the green-sensitive layers can be improved at the same time.

As in Examples 3 and 4, when each of the blue-, green-, and red-sensitive layers consists of a plurality of emulsion layers, the tabular grain emulsion should be used as emulsion layers having large light scattering and the mono-dispersed emulsion must be used as those having small light scattering so as to improve sharpness and graininess. When the tabular grain emulsion is used also in the red-sensitive layers in Example (4), light scattering between the emulsion layers is sometimes increased to degrade sharpness of the green-sensitive layers on the red-sensitive layers. That is, it is not always preferable to use the tabular grain emulsion as the red-sensitive layer closest to the support.

As described above, the tabular and non-tabular grain emulsions for use in this invention are usually subjected to physical ripening, chemical ripening, and spectral sensitization. Additives which are used in such steps are described in Research Disclosures, RD No. 17643 (December 1978) and RD No. 18716 (November 1979) and they are summarized in the following table.

In this case, a spectral sensitizing dye may be added before chemical sensitization starts. In addition, a plurality of sensitizing dyes of 500 nm or less may be used at the same time.

Also, photographic additives which can be used in this invention are described in the above-described two Research Disclosures publications and they are also summarized in the same table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizers | page 25 | |
| 9. Hardening agents column | page 26 | page 651, left |
| 10. Binder | page 26 | page 651, left |
| 11. Plasticizers, lubricants | page 27 | page 650, right column |
| 12. Coating aids, surface active agents | pages 26–27 | page 650, right column |
| 13. Antistatic agents | page 27 | page 650, right column |

In this invention, various color couplers can be used in the light-sensitive material. Specific examples of these couplers are described in above-described Research Disclosure, No. 17643, VII-C to VII-G as patent references. As dye-forming couplers, couplers giving three primary colors (i.e., yellow, magenta, and cyan) by subtraction color process by color development are typically important, and specific examples of non-diffusible couplers, four-equivalent couplers, and two-equivalent couplers are described in Patents referred in above-described Research Disclosure, No. 17643, VII-C and VII-D and further the following couplers can be also preferably used in this invention.

Typical yellow couplers which can be used in the light-sensitive material of this invention include hydrophobic acetylacetamide series couplers having a ballast group. Specific examples of the yellow coupler are described in U.S. Pat. Nos. 2,407,210, 2,875,057, and 3,265,506. In this invention, the use of two-equivalent yellow couplers is preferred. Typical examples thereof are the oxygen atom-releasing type yellow couplers described in U.S. Pat. Nos. 3,408,194, 3,447,928, 3,933,501, and 4,022,620 and the nitrogen atom-releasing type yellow couplers described in Japanese Patent Publication 10,739/83, U.S. Pat. Nos. 4,401,752, 4,326,024, Research Disclosure, No. 18053 (April, 1979), British Pat. No. 1,425,020, West German Patent Application (OLS) Nos. 2,219,917, 2,261,361, 2,329,587, and 2,433,812. Furthermore, α-pivaloylacetanilide series couplers are excellent in fastness, in particular light fastness of the colored dye. On the other hand, α-benzoylacetanilide series couplers show high coloring density.

Typical magenta couplers which can be used in the light-sensitive material of this invention include hydrophobic indazolone type or cyanoacetyl series, preferably 5-pyrazolone type and pyrazoloazole series couplers each having a ballast group. The 5-pyrazolone series couplers the 3-position of which is substitued by an arylamino group or an acylamino group are preferred in the view points of the hue and coloring density of the colored dye. Specific examples of such couplers are described in, for example, U.S. Pat. Nos. 2,311,082, 2,343,703, 2,600,788, 2,908,573, 3,062,653, 3,152,896, and 3,936,015. As the releasable group of a two-equivalent 5-pyrazolone type coupler, the nitrogen atom releasing group described in U.S. Pat. No. 4,310,619 and the arylthio group described in U.S. Pat. No. 4,351,897 are particularly preferred. Also, the 5-pyrazolone type couplers having ballast group described in European Pat. No. 73,636 give high coloring density. As the pyrazoloazole type magenta couplers, there are the pyrazolobenzimidazoles described in U.S. Pat. No. 3,061,432, preferably the pyrazolo[5,1-c][1,2,4]triazoles described in U.S. Pat. No. 3,725,067, the pyrazolotetrazoles described in Research Disclosure, RD No. 24220 (June, 1984) and Japanese patent application (OPI) No. 33,552/85, and the pyrazolopyrazoles described in Research Disclosure, RD No. 24230 (June, 1984) and Japanese patent application (OPI) No. 43,659/85. With respect to the points of showing less side yellow absorption and light fastness of the colored dye, the imidazo[1,2-b]pyrazoles described in U.S. Pat. No. 4,500,630 are preferred and the pyrazolo[1,5-b][1,2,4]triazolos described in European Pat. No. 119,860A are particularly preferred.

Typical cyan couplers which can be used in the light-sensitive material of this invention include hydrophobic and non-diffusible naphtholic and phenolic couplers. Typical examples of the cyan couplers are the naphtholic couplers described in U.S. Pat. No. 2,474,293 and preferably the oxygen atom releasing type two-equivalent naphtholic couplers described in, for example, U.S. Pat. Nos. 4,052,212, 4,146,396, 4,228,233, and 4,296,200. Also, specific examples of the phenolic couplers are described in U.S. Pat. Nos. 2,369,929, 2,801,171, 2,772,162, and 2,895,826.

Cyan couplers which form dyes having fastness to humidity and temperature are preferably used in this invention and specific examples of such cyan couplers are the phenolic cyan couplers having an alkyl group of at least 2 carbon atoms at the metaposition of the phenol nucleus described in U.S. Pat. No. 3,772,002, the 2,5-diacylamino-substituted phenolic couplers described in U.S. Pat. Nos. 2,772,162, 3,758,308, 4,126,396, 4,334,011, and 4,327,173, West German patent application (OLS) No. 3,329,720, and European Pat. No. 121,365, and the phenolic couplers having a phenylureido group at the 2-position thereof and an acylamino group at the 5-position thereof described in U.S. Pat. Nos. 3,446,622, 4,333,999, 4,451,559, and 4,427,767. A naphotolic cyan coupler in which a sulfonamido group, an amide group, or the like is substituted at the 5-position described in European Pat. No. 161,626A has excellent fastness of the colored image and hence can be preferably used in this invention.

For correcting additional, undesirable absorption of colored dye, it is preferred to perform color masking by using colored couplers together in the case of color photographic materials for in-camera use. Specific examples of these colored couplers are the yellow-colored magenta couplers described in U.S. Pat. No. 4,163,670 and Japanese Patent Publication No. 39,413/82, and the magenta-colored cyan couplers described in U.S. Pat. Nos. 4,004,929, 4,138,258 and British Patent No. 1,146,368. Other colored couplers which can be used in this invention are described in above-described Research Disclosure, RD No. 17643, VII-G.

In this invention, the graininess can be improved by using together couplers capable of forming colored dyes having proper diffusibility. As such couplers, specific examples of magenta couplers are described in U.S. Pat. No. 4,366,237 and British Pat. No. 2,125,570 and specific examples of yellow couplers, magenta couplers and cyan couplers are described in European Pat. No. 96,570 and West German patent application (OLS) No. 3,234,533.

The dye-forming couplers and the above-described specific couplers each may form a dimer or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

Couplers releasing a photographically useful residue upon coupling are preferably used in this invention. DIR couplers, i.e., couplers releasing development inhibitor are described in the patents cited in the above-described Research Disclosure, No. 17643, VII-F.

Preferred examples of these couplers which can be used in this invention are the developer inactivating type couplers described Japanese patent application (OPI) No. 151,944/82, the timing type couplers described in, for example, U.S. Pat. No. 4,248,962 and Japanese patent application (OPI) No. 154,234/82, the reaction type couplers described in Japanese patent application (OPI) No. 39,653/84. Particularly preferred examples of these couplers are the development inactivating type DIR couplers described in, for example, Japanese patent application (OPI) Nos. 151,944/82, 217,932/83, Japanese patent application Nos. 75,474/84, 82,214/84, 90,438/84, and the reaction type DIR couplers described in, for example, Japanese patent application No. 39,653/84.

For the photographic light-sensitive materials of this invention, couplers imagewise releasing a nucleating agent or a development accelerator at development can be used. Specific examples of these couplers are described in British Pat. Nos. 2,097,140 and 2,131,188. Also, couplers releasing a nucleating agent having an adsorptive action for silver halide are particularly preferred in this invention and specific examples thereof are described in Japanese patent application (OPI) Nos. 157,638/84 and 170,840/84.

The couplers for use in this invention can be used in the light-sensitive materials by various known dispersion methods.

Examples of a high-boiling solvent used in an oil-in-water dispersion method are described in U.S. Pat. 2,322,027 and the like.

Steps and effects of a latex dispersion method and examples of a loadable latex are described in, for example, U.S. Pat. No. 4,199,363, West German patent application (OLS) Nos. 2,541,274 and 2,541,230.

Examples of a support suitable for use in this invention are described in the above-described RD. No. 17643, page 28 and ibid., No. 18716, page 647, right column to page 648, left column.

The color photographic light-sensitive materials of this invention can be processed by the ordinary processes as described, for example, in above-described Research Disclosure, No. 17643, pages 28 to b 29 and ibid., No. 18716, page 651, left column to right column.

The color photographic light-sensitive materials of this invention are usually subjected to a water-washing treatment or stabilization treatment after development and blixing or fixing.

The water washing step is generally performed by a countercurrent washing using two or more water baths in order to save water. Also, as the stabilizing process, the multistage countercurrent stabilizing process described in Japanese patent application (OPI) No. 8543/82 is typical. Such a stabilizing process may be used in place of the water washing step. In the case of the stabilizing process, 2 to 9 counter-current baths are required. The stabilizing composition contains various compounds for stabilizing images. For example, there are various kinds of buffers (e.g., borates, metaborates, borax, phosphates, carbonates, potassium hydroxide, sodium hydroxide, aqueous ammonia, monocarboxylic acids, dicarboxylic acids, polycarboxylic acids, or a combination thereof) and formalin for adjusting the pH of films (e.g., pH 3 to 8). Furthermore, if necessary, the stabilizer composition may contain other additives such as a water softener (e.g., an inorganic phosphoric acid, aminopolycarboxylic acid, an organic phosphoric acid, and aminopolyphosphonic acid, a phosphonocarboxylic acid), a germicide (e.g., benzoisothiazolinone, isothiazolone, 4-thiazolinebenzimidazole, halogenated phenol), a surface active agent, an optical whitening agent, a hardening agent. Two or more kinds of these compounds may be used in combination.

Also, as the film pH adjustig agent after processing, the use of an ammonium salt such as ammonium chloride, ammonium nitrate, ammonium sulfate, ammonium phosphate, ammonium sulfate, ammonium thiosulfate, is preferred.

This invention can be applied to various kinds of color photographic light-sensitive materials. For example, there are general negative color photographic films, negative color photographic cinema films, color reversal photographic films for slide or television, color photographic papers, color positive photographic films, color reversal photographic papers. This invention can be also applied to a black and white light-sensitive material utilizing a mixture of three-color couplers described in Research Disclosure, RD., No. 17123 (July, 1978).

DETAILED DESCRIPTION OF THE PREFERRED EXAMPLES

Figure 1:
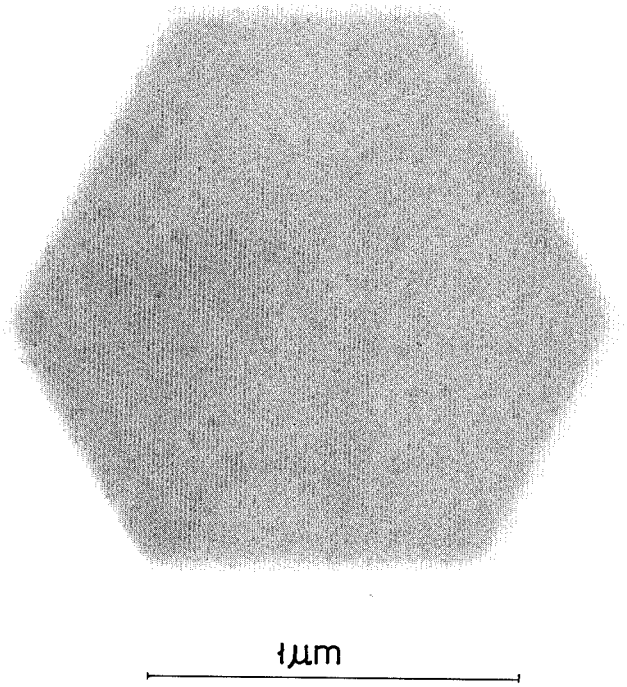
FIGS. 1, 2, and 3 are electron microscopic photographs of typical silver halide crystal grains contained in emulsions A, 1, and 2 of Example 1, respectively.

The present invention will be described by way of its Examples below.

EXAMPLE 1

(1) Preparation of Emulsions

While an aqueous solution obtained by dissolving 6 g of potassium bromide and 30 g of inactive gelatin to 3.7 liter of distilled water was agitated, a 14% aqueous potassium bromide solution and a 20% aqueous silver nitrate solution were added to the above aqueous solution by a double jet method at constant flow rates, over one minute, under the conditions of 55° C. and a pBr of 1.0 (in this addition (I), 2.40% of a total silver amount was consumed). Then, an aqueous gelatin solution (17%, 300 cc) was added to the resultant mixture, and the solution was agitated at 55° C. Thereafter, a 20% aqueous silver nitrate solution was added to the mixture at a constant flow rate until the pBr reached 1.40 (in this addition (II), 5.0% of the total silver amount was consumed). A 20% aqueous potassium bromide solution containing 8.3 g of pottassium iodide and a 33% aqueous silver nitrate solution were added to the resultant mixture by the double jet method, over 80 minutes (in this addition (III), 92.6% of the total silver amount was consumed). During the addition, a temperature and the pBr were maintained at 55° C. and 1.50, respectively. A silver nitrate amount used in this emulsion was 425 g. Then, the resultant solution was desalted by a conventional flocculation method and optimally subjected to gold-plus-sulfur sensitization. As a result, comparative emulsion A containing tabular AgBrI (AgI=2.0 mol%) grains having a mean grain diameter/thickness ratio of 6.5 and a sphere-equivalent diameter of 0.8$\mu$ was prepared.

The "sphere-equivalent" diameter is a diameter which the grain would have if it were spherical.

Comparative emulsion B containing tabular AgBrI (AgI=2.0 mol%) grains, wherein a mean grain diameter/thickness ratio was 6.4 and a sphere-equivalent diameter was 0.8$\mu$, was prepared following the same procedures as for emulsion A except that potassium iodide was removed from the halide solution used in addition (III) and a solution containing 8.3 g of potassium iodide was added at the end of addition (III).

Emulsion 1 of this invention containing tabular AgBrI (AgI=2.0 mol%) grains, wherein a mean grain diameter/thickness ratio was 6.3 and a sphere-equivalent diameter was 0.8$\mu$, was prepared following the same procedures as for emulsion B except that when 57% of the total silver amount was consumed in addition (III), addition of silver nitrate and potassium bromide was temporarily stopped and a solution containing 8.3 g of potassium iodide was added.

Emulsion 2 of this invention containing tabular AgBrI (AgI=2.0 mol%) grains, wherein a mean grain diameter/thickness ratio was 6.0 and a sphere-equivalent diameter was 0.8$\mu$, was prepared following the same procedures as for emulsion A except that a 20% aqueous potassium bromide solution containing 4.0 g of potassium iodide was used as a halide solution in addition (III), and when 25% of the total silver amount was consumed in addition (III), addition of silver nitrate and the above halide solution was temporarily stopped and a solution containing 4.3 g of potassium iodide was added.

(2) Observation of Dislocations in Grains

Dislocations in grains in emulsions A, B, 1, and 2 were directly observed using the transmission electron microscope described in this specification. The JEM-2000FX (tradename) available from Nihon Denshi K.K. was used as the electron microscope, and observation was performed with a voltage of 200 KV at a liquid nitrogen temperature.

FIG. 1 is a photograph of typical grains obtained in emulsion A. In the photograph of FIG. 1, round black spots are found at random positions. These spots are sometimes gradually enlarged during observation and hence can be assumed to be contamination or print out silver. That is, no clear dislocations are found in FIG. 1. In emulsion A, 90% or more of the total of grains are such grains as shown in FIG. 1.

Figure 2:
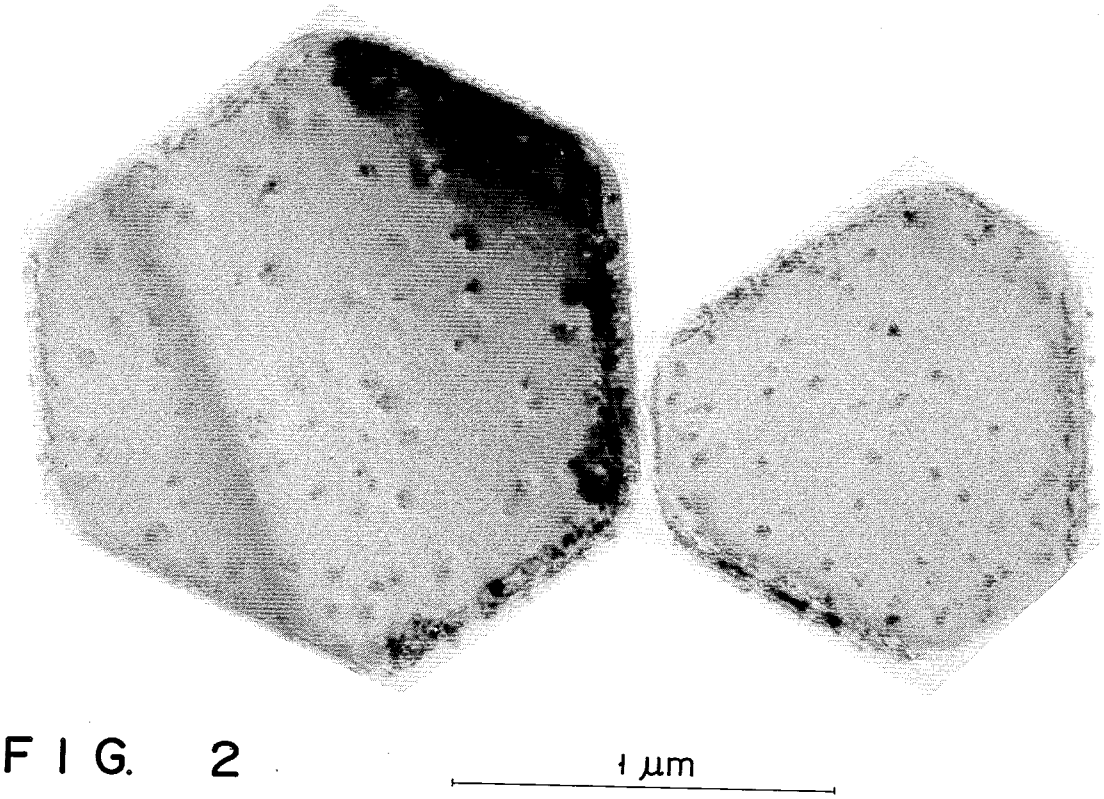

FIG. 2 is a photograph of typical grains obtained in emulsion 1. In the photograph of FIG. 2, in addition to the black spots as in FIG. 1, a large number of dislocation lines are clearly found from a position away from the center of the grain by about 90% of a length between the center and an edge, to the edge. In emulsion 1, 80% or more (number) of the total of silver halide grains include 20 or more of such dislocation lines.

Figure 3:
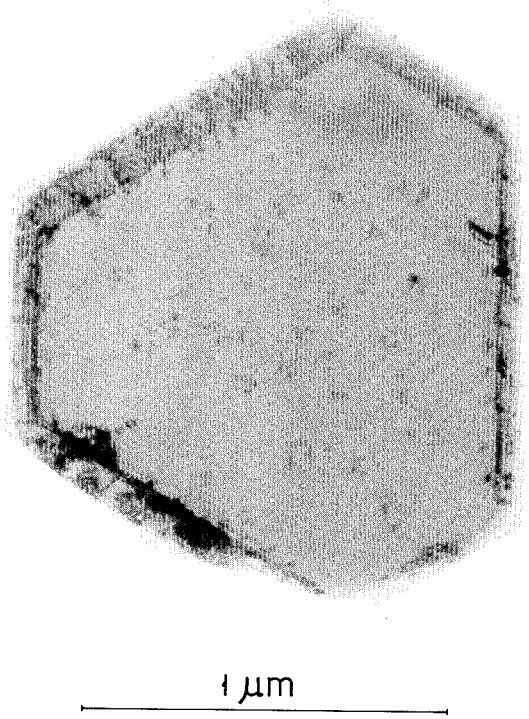

FIG. 3 is a photograph of typical grains obtained in emulsion 2. In the photograph of FIG. 3, a large number of dislocation lines are clearly found from a position away from the center of the grain by about 80% of a length between the center and an edge, to the edge as in FIG. 2. In emulsion 2, 90% or more (number) of the total of silver halide grains include 20 or more of such dislocation lines.

In emulsion B, no dislocation lines as in FIGS. 2 and 3 were observed (in this sample a large number of AgI grains were adhered to a portion near an edge of tabular grain).

(3) Preparation and Evaluation of Coated Samples

Sensitizing dye S-5 was added to the emulsions obtained in (1). Then, docecylbenzene sulfonate as a coating aid, p-vinyl benzene sulfonate as a thickening agent, a vinyl sulfonate series compound as a hardening agent, and a polyethylene oxide series compound as a photographic characteristics modifying agent were added to the resultant emulsions, thereby obtaining emulsion liquids for coating. Subsequently, these liquids for coating were independently uniformly applied on an undercoated polyester base, and a surface protective layer mainly consisting of an aqueous gelatin solution was applied thereon. As a result, coated samples 1 and 2 respectively having comparative emulsions A and B and coated samples 3 and 4 respectively having emulsions 1 and 2 of this invention were prepared. In samples 1 to 4, an amount of coated silver was 4.0 g/m$^2$, an amount of coated gelatin of protective layers was 1.3 g/m$^2$, and an amount of coated gelatin emulsion layers was 2.7 g/m$^2$.

In order to evaluate the coated samples obtained as described above, the following tests were performed.

(1) Exposure Intensity Dependency; Sample pieces of coated samples 1 to 4 subjected to wedge exposure with an exposure amount of 50 CMS for an exposure time of 1/100" and with an exposure amount of 50 CMS for an exposure time of 10" were simultaneously developed by a processing solution consisting of the following composition at 20° C. for 4'. Then, after fixing, washing, and drying, sensitometry was performed. Thereafter, sensitivity was obtained in accordance with a reciprocal of an exposure amount which gives a density of fog+0.1, and values of 1/100"- and 10"-exposures were compared.

(2) Resistance to incubation; Three sets of sample pieces of coated samples 1 to 4 were prepared. One of the three sets was kept at a temperature of 50° C. and a humidity of 30% RH for three days, another set was kept at 50° C. and 80% RH, and the remaining one was kept at room temperature as a control test. These samples were wedge-exposed for 1/100" and subjected to the treatment and sensitometry following the same procedures as in (1) to obtain sensitivity. Then, values of the obtained sensitivity were compared.

(3) Latent Image Stability; Three sets of sample pieces of coated samples 1 to 4 were prepared and wedge-exposed for 1/100". Then, one of the three sets was kept at 50° C. and 30% RH for three days, another set was kept at 50° C. and 80% RH for three days, and the remaining one was kept in a freezer as a control test. Following the same procedures as in (1), these samples were subjected to the treatment and sensitometry to obtain sensitivity. Then, values of the obtained sensitivity were compared.

(4) Resistance to pressure; Sample pieces of coated samples 1 to 4 were bent through a predetermined angle and processed following the same procedures as in (1). Then, values of fog density at bent portions were compared.

| Processing Solution: | |
|---|---|
| 1-phenyl-3-pyrazolidone | 0.5 g |
| Hydroquinone | 10 g |
| Disodium Ethylenediaminetetraacetate | 2 g |
| Potassium Sulfite | 60 g |
| Boric Acid | 4 g |
| Potassium Carbonate | 20 g |
| Sodium Bromide | 5 g |
| Diethylene Glycol | 20 g |
| Sodium Hydroxide to obtain a pH of | 10.0 |
| Water to make | 1 liter |

As is apparent from Table 1, as compared with samples 1 and 2 comprising comparative emulsions A and B, samples 3 and 4 comprising emulsions 1 and 2 of this invention had higher sensitivities, smaller desensitization at low intensity, and smaller sensitization and latent image fading upon incubation. That is, the effects of this invention are notable. In addition, samples 3 and 4 had less stress marks than sample 1.

TABLE 1

| Sample No. | Emulsion | Exposure Intensity Dependency 1/100" | Exposure Intensity Dependency 10" | Resistance to Incubation 50° C., 30% | Resistance to Incubation 50° C., 80% | Latent Image Stability 50° C., 30% | Latent Image Stability 50° C., 80% | |
|---|---|---|---|---|---|---|---|---|
| 1 | Emulsion A | 100 | 50 | 120 | 110 | 60 | 45 | Comparative Example |
| 2 | Emulsion B | 20 | 1 | 2 | 1 | 8 | 2 | Comparative Example |
| 3 | Emulsion 1 | 120 | 90 | 125 | 120 | 105 | 90 | Present Invention |
| 4 | Emulsion 2 | 125 | 105 | 125 | 120 | 115 | 100 | Present Invention |

Note:
values in this table indicate sensitivities which are represented assuming that sensitivity of sample 1 exposed for 1/100" is 100.

EXAMPLE 2

A multilayer color light-sensitive material comprising a plurality of layers having the following compositions was formed on an undercoated triacetylcellulose film support to prepare samples 101 to 104 containing emulsions A, B, 1, and 2 described in Example 1 in their third green-sensitive layers and second and third blue-sensitive layers.

Layer 1: Antihalation Layer:

-continued

| | |
|---|---|
| Black Colloid Silver | 0.25 g/m$^2$ |
| Ultraviolet Absorbent U-1 | 0.1 g/m$^2$ |
| Ultraviolet Absorbent U-2 | 0.1 g/m$^2$ |
| High Boiling Organic Solvent Oil-1 | 0.1 cc/cm$^2$ |
| Gelatin | 1.9 gc/m$^2$ |
| Layer 2: Interlayer-1: | |
| Compound Cpd D | 10 mg/m$^2$ |
| High Boiling Organic Solvent Oil-3 | 40 mg/m$^2$ |
| Gelatin | 0.4 g/m$^2$ |
| Layer 3: Interlayer-2: | |
| Surface-fogged Fine Silver Iodobromide Emulsion (mean grain size: 0.06μ, AgI content: 1 mol %) silver | 0.05 g/m$^2$ |
| Gelatin | 0.4 g/m$^2$ |
| Layer 4: 1st Red-sensitive Emulsion Layer: | |
| Silver Iodobromide Emulsion (a 1:1 mixture of a mono-dispersed cubic emulsion having a mean grain size of 0.2μ and an AgI content of 5 mol % and a mono-dispersed cubic emulsion having a mean grain size of 0.1μ and an AgI content of 5 mol %) Spectrally Sensitized with Sensitizing Dyes S-1 and S-2 silver | 0.4 g/m$^2$ |
| Coupler C-1 | 0.2 g/m$^2$ |
| Coupler C-2 | 0.05 g/m$^2$ |
| High Boiling Organic Solvent Oil-1 | 0.1 cc/m$^2$ |
| Gelatin | 0.8 g/m$^2$ |
| Layer 5: 2nd Red-sensitive Emulsion Layer: | |
| Silver Iodobromide Emulsion (a mono-dispersed cubic emulsion having a mean grain size of 0.3μ and an AgI content of 4 mol %) Spectrally Sensitized with Sensitizing Dyes S-1 and S-2 silver | 0.4 g/m$^2$ |
| Coupler C-1 | 0.2 g/m$^2$ |
| Coupler C-3 | 0.2 g/m$^2$ |
| Coupler C-2 | 0.05 g/m$^2$ |
| High Boiling Organic Solvent Oil-1 | 0.1 cc/cm$^2$ |
| Gelatin | 0.8 g/m$^2$ |
| Layer 6: 3rd Red-sensitive Emulsion Layer: | |
| Silver Iodobromide Emulsion (a mono-dispersed cubic emulsion having a mean grain size of 0.4μ and an AgI content of 2 mol %) Spectrally Sensitized with Sensitizing Dyes S-1 and S-2 silver | 0.4 g/m$^2$ |
| Coupler C-3 | 0.7 g/m$^2$ |
| Gelatin | 1.1 g/m$^2$ |
| Layer 7: Interlayer-3: | |
| Dye D-1 | 0.02 g/m$^2$ |
| Gelatin | 0.6 g/m$^2$ |
| Layer 8: Interlayer-4: | |
| Surface-fogged Fine Silver Iodobromide Emulsion (mean grain size: 0.06μ, AgI content: 1 mol %) silver | 0.05 g/m$^2$ |
| Compound Cpd A | 0.2 g/m$^2$ |
| Gelatin | 1.0 g/m$^2$ |
| Layer 9: 1st Green-sensitive Emulsion Layer: | |
| Silver Iodobromide Emulsion (a 1:1 mixture of a mono-dispersed cubic emulsion having a mean grain size of 0.2μ and an AgI content of 5 mol % and a mono-dispersed cubic emulsion having a mean grain size of 0.1μ and an AgI content of 5 mol %) Spectrally Sensitized with Sensitizing Dyes S-3 and S-4 silver | 0.5 g/m$^2$ |
| Coupler C-4 | 0.3 g/m$^2$ |
| Compound Cpd B | 0.03 g/m$^2$ |
| Gelatin | 0.5 g/m$^2$ |
| Layer 10: 2nd Green-sensitive Emulsion Layer: | |
| Silver Iodobromide Emulsion (a mono-dispersed cubic emulsion having a mean grain size of 0.4μ and an AgI content of 5 mol %) Spectrally Sensitized with Sensitizing Dyes S-3 and S-4 silver | 0.4 g/m$^2$ |
| Coupler C-4 | 0.3 g/m$^2$ |
| Compound Cpd B | 0.03 g/m$^2$ |

-continued

| | |
|---|---|
| Gelatin | 0.6 g/m$^2$ |
| Layer 11: 3rd Green-sensitive Emulsion Layer: | |
| Silver Iodobromide Emulsion (emulsion A, B, 1, or 2 described in Example 1) Spectrally Sensitized with Sensitizing Dyes S-3 and S-4 silver | 0.5 g/m$^2$ |
| Coupler C-4 | 0.8 g/m$^2$ |
| Compound Cpd B | 0.08 g/m$^2$ |
| Gelatin | 1.0 g/m$^2$ |
| Layer 12: Interlayer-5: | |
| Dye D-2 | 0.05 g/m$^2$ |
| Gelatin | 0.6 g/m$^2$ |
| Layer 13: Yellow Filter Layer: | |
| Yellow Colloid Silver | 0.1 g/m$^2$ |
| Compound Cpd A | 0.01 g/m$^2$ |
| Gelatin | 1.1 g/m$^2$ |
| Layer 14: 1st Blue-sensitive Emulsion Layer: | |
| Silver Iodobromide Emulsion (a 1:1 mixture of a mono-dispersed cubic emulsion having a mean grain size of 0.2μ and an AgI content of 3 mol % and a mono-dispersed cubic emulsion having a mean grain size of 0.1μ and an AgI content 3 mol %) Spectrally Sensitized with Sensitizing Dyes S-5 and S-6 silver | 0.6 g/m$^2$ |
| Coupler C-5 | 0.6 g/m$^2$ |
| Gelatin | 0.8 g/m$^2$ |
| Layer 15: 2nd Blue-sensitive Emulsion Layer: | |
| Silver Iodobromide Emulsion (the same emulsion as the emulsion of the 3rd green-sensitive emulsion layer) Spectrally Sensitized with Sensitizing Dyes S-5 and S-6 silver | 0.4 g/m$^2$ |
| Coupler C-5 | 0.3 g/m$^2$ |
| Coupler C-6 | 0.3 g/m$^2$ |
| Gelatin | 0.9 g/m$^2$ |
| Layer 16: 3rd Blue-sensitive Emulsion Layer: | |
| Silver Iodobromide Emulsion (the same emulsion as the emulsion of the 3rd green-sensitive emulsion layer) Spectrally Sensitized with Sensitizing Dyes S-5 and S-6 silver | 0.4 g/m$^2$ |
| Coupler C-6 | 0.7 g/m$^2$ |
| Gelatin | 1.2 g/m$^2$ |
| Layer 17: 1st Protective Layer: | |
| Ultraviolet Absorvent U-1 | 0.04 g/m$^2$ |
| Ultraviolet Absorvent U-3 | 0.03 g/m$^2$ |
| Ultraviolet Absorvent U-4 | 0.03 g/m$^2$ |
| Ultraviolet Absorvent U-5 | 0.05 g/m$^2$ |
| Ultraviolet Absorvent U-6 | 0.05 g/m$^2$ |
| Compound Cpd C | 0.8 g/m$^2$ |
| Dye D-3 | 0.05 g/m$^2$ |
| Gelatin | 0.7 g/m$^2$ |
| Layer 18: 2nd Protective Layer: | |
| Surface-fogged Fine Silver Iodobromide Emulsion (mean grain size: 0.06μ, AgI content: 1 mol %) silver | 0.1 g/m$^2$ |
| Polymethyl Methacrylate Grains (mean grain size: 1.5μ) | 0.1 g/m$^2$ |
| 4:6 Copolymer of Methyl Methacrylate and Acrylic Acid (mean grain size: 1.5μ) | 0.1 g/m$^2$ |
| Silicone Oil | 0.03 g/m$^2$ |
| Fluorine-containing Surface Active Agent W-1 | 3 mg/m$^2$ |
| Gelatin | 0.8 g/m$^2$ |

Gelatin hardening agent H-1 and a surface active agent were added to the layers in addition to the above compositions.

Samples 101 to 104 obtained as described above were processed following the same procedures as in (1) to (4) in Example 1 except for development, and developed as described below.

| Process Steps of Development: | | |
|---|---|---|
| Step | Time | Temperature |
| 1st Development | 6 min. | 38° C. |
| Washing | 2 min. | 38° C. |
| Reversal Development | 2 min. | 38° C. |
| Color Development | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Stabilizing | 1 min. | Room Temperature |
| Drying | | |

The compositions of processing solutions were as follows.

| | |
|---|---|
| First Developer: | |
| Water | 700 ml |
| Pentasodium Nitrilo-N,N,N—trimethylenephosphonate | 2 g |
| Sodium Sulfite | 20 g |
| Hydroquinone Monosulfonate | 30 g |
| Sodium Carbonate (Monohydrate) | 30 g |
| 1-phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| Reversing Solution: | |
| Water | 700 ml |
| Pentasodium Nitrilo-N,N,N—trimethylenephosphonate | 3 g |
| Stannous Chloride (Dihydrate) | 1 g |
| p-aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Pentasodium Nitrilo-N,N,N—trimethylenephosphonate | 3 g |
| Sodium Sulfite | 7 g |
| Tribasic Sodium Phosphate (Dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—ethyl-N—(β-methanesulfonamidoethyl)-3-methyl-4-aminoaniline Sulfate | 11 g |
| 3,6-dithiaoctane-1,8-diol | 1 g |
| Water to make | 1,000 ml |
| Conditioning Solution: | |
| Water | 700 ml |
| Sodium Sulfite | 12 g |
| Sodium Ethylenediaminetetraacetate (Dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium ethylenediaminetetraacetate (Dihydrate) | 2 g |
| Ammonium Iron (III) Ethylenediaminetetraacetate (Dihydrate) | 120 g |
| Potassium Bromide | 100 g |
| Water to make | 1,000 ml |
| Fixing Solution: | |
| Water | 800 ml |
| Ammonium Thiosulfate | 80.0 g |

-continued

| | |
|---|---|
| Sodium Sulfite | 5.0 g |
| Sodium Bisulfite | 5.0 g |
| Water to make | 1,000 ml |
| Stabilizing Solution: | |
| Water | 800 ml |
| Formalin (37 wt %) | 5.0 ml |
| Fuji Driwel (surface active agent available from Fuji Photo Film Co., Ltd.) | 5.0 ml |
| Water to make | 1,000 ml |

Color reversal sensitivities of the 3rd green-sensitive layer and the 2nd and 3rd blue-sensitive layers were estimated on the basis of a relative exposure amount for giving density larger by 2.0 than a minimum density of magenta and yellow densities.

As a result, the similar results to the results in Example-1-(3) were obtained. As for resistance to pressure, as compared with comparative sample 101, reductions in the yellow and magenta densities of pressurized portions at the high density side of samples 103 and 104 of this invention are largely reduced.

EXAMPLE 3

Layers consisting of the following compositions were applied on an undercoated triacetylcellulose support, thereby preparing multilayer color light-sensitive material samples 201 to 204 containing emulsions A, B, 1, and 2 described in Example 1 in their 3rd green-sensitive layers and 3rd blue-sensitive layers.

| | |
|---|---|
| Layer 1: Antihalation Layer: | |
| Black Colloid Silver silver | 0.18 g/m$^2$ |
| Gelatin | 1.40 g/m$^2$ |
| Layer 2: Interlayer: | |
| 2,5-di-t-Pentadecyl Hydroquinone | 0.18 g/m$^2$ |
| C-11 | 0.07 g/m$^2$ |
| C-13 | 0.02 g/m$^2$ |
| U-11 | 0.08 g/m$^2$ |
| U-12 | 0.08 g/m$^2$ |
| Oil-2 | 0.10 g/m$^2$ |
| Oil-1 | 0.02 g/m$^2$ |
| Gelatin | 1.0 g/m$^2$ |
| Layer 3: 1st Red-sensitive Emulsion Layer: | |
| Silver Iodobromide Emulsion (irregular multi-twinning grains having an iodide content of 2 mol % and a mean grain sphere-equivalent size of 0.3μ) Spectrally Sensitized with Sensitizing Dyes S-11, S-12, S-13, and S-18 silver | 1.15 g/m$^2$ |
| C-12 | 0.14 g/m$^2$ |
| Oil-2 | 0.005 g/m$^2$ |
| C-20 | 0.005 g/m$^2$ |
| Gelatin | 1.20 g/m$^2$ |
| Layer 4: 2nd Red-sensitive Emulsion Layer: | |
| Silver Iodobromide Emulsion (irregular multi-twinning grains having an iodide content of 2 mol % and a mean grain sphere-equivalent size of 0.6μ) Spectrally Sensitized with Sensitizing Dyes S-11, S-12, S-13, and S-18 silver | 1.50 g/m$^2$ |
| C-12 | 0.060 g/m$^2$ |
| C-13 | 0.008 g/m$^2$ |
| C-20 | 0.004 g/m$^2$ |
| Oil-2 | 0.005 g/m$^2$ |
| Gelatin | 1.50 g/m$^2$ |
| Layer 5: 3rd Red-sensitive Emulsion Layer: | |
| Silver Iodobromide Emulsion (irregular multi-twinning grains having an iodide content of 2 mol % and a mean grain sphere-equivalent size of 0.8μ) Spectrally Sensitized with Sensitizing Dyes S-11, S-12, S-13, and S-18 silver | 1.50 g/m$^2$ |

-continued

| | |
|---|---|
| C-15 | 0.012 g/m² |
| C-13 | 0.003 g/m² |
| C-14 | 0.004 g/m² |
| Oil-2 | 0.32 g/m² |
| Gelatin | 1.63 g/m² |
| Layer 6: Interlayer: | |
| Gelatin | 1.06 g/m² |
| Layer 7: 1st Green-sensitive Emulsion Layer: | |
| Silver Iodobromide Emulsion (irregular multi-twinning grains having an iodide content of 2 mol % and a mean grain sphere-equivalent size of 0.3μ) Spectrally Sensitized with Sensitizing Dyes S-14, S-15, and S-16 | |
| silver | 0.35 g/m² |
| C-16 | 0.120 g/m² |
| C-11 | 0.021 g/m² |
| C-17 | 0.030 g/m² |
| C-18 | 0.025 g/m² |
| Oil-2 | 0.20 g/m² |
| Gelatin | 0.70 g/m² |
| Layer 8: 2nd Green-sensitive Emulsion Layer: | |
| Silver Iodobromide Emulsion (irregular multi-twinning grains having an iodide content of 2 mol % and a mean grain sphere-equivalent size of 0.6μ) Spectrally Sensitized with Sensitizing Dyes S-14, S-15, and S-16 | |
| silver | 0.75 g/m² |
| C-16 | 0.021 g/m² |
| C-18 | 0.004 g/m² |
| C-11 | 0.002 g/m² |
| C-17 | 0.003 g/m² |
| Oil-2 | 0.15 g/m² |
| Gelatin | 0.80 g/m² |
| Layer 9: 3rd Green-sensitive Emulsion Layer: | |
| Silver Iodobromide Emulsion (emulsion A, B, 1, or 2 described in Example 1) Spectrally Sensitized with Sensitizing Dyes S-14, S-15, and S-16 | |
| silver | 1.80 g/m² |
| C-16 | 0.011 g/m² |
| C-11 | 0.001 g/m² |
| Oil-1 | 0.69 g/m² |
| Gelatin | 1.74 g/m² |
| Layer 10: Yellow Filter Layer: | |
| Yellow Colloid Silver silver | 0.05 g/m² |
| 2,5-di-t-pentadecyl Hydroquinone | 0.03 g/m² |
| Gelatin | 0.95 g/m² |
| Layer 11: 1st Blue-sensitive Emulsion Layer: | |
| Silver Iodobromide Emulsion (irregular multi-twinning grains having an iodide content of 2 mol % and a mean grain sphere-equivalent size of 0.3μ) Spectrally Sensitized with Sensitizing Dye S-17 | |
| silver | 0.24 g/m² |
| C-19 | 0.27 g/m² |
| C-18 | 0.005 g/m² |
| Oil-2 | 0.28 g/m² |
| Gelatin | 1.28 g/m² |
| Layer 12: 2nd Blue-sensitive Emulsion Layer: | |
| Silver Iodobromide Emulsion (irregular multi-twinning grains having an iodide content of 2 mol % and a mean grain sphere-equivalent size of 0.6μ) Spectrally Sensitized with Sensitizing Dye S-17 | |
| silver | 0.45 g/m² |
| C-19 | 0.098 g/m² |
| Oil-2 | 0.03 g/m² |
| Gelatin | 0.46 g/m² |
| Layer 13: 3rd Blue-sensitive Emulsion Layer: | |
| Silver Iodobromide Emulsion (the same emulsion as the emulsion of the 3rd green-sensitive layer) Spectrally Sensitized with Sensitizing Dye S-17 | |
| silver | 0.77 g/m² |
| C-19 | 0.036 g/m² |
| Oil-2 | 0.07 g/m² |
| Gelatin | 0.69 g/m² |
| Layer 14: 1st Protective Layer: | |
| Silver Iodobromide (silver iodide: 1 mol %, mean grain size: 0.07μ) | |
| silver | 0.5 g/m² |
| U-11 | 0.11 g/m² |
| U-12 | 0.17 g/m² |
| Oil-2 | 0.90 g/m² |
| Layer 15: 2nd Protective Layer: | |
| Polymethylmethacrylate Grains (size: about 1.5 μm) | 0.54 g/m² |
| U-13 | 0.15 g/m² |
| U-14 | 0.10 g/m² |
| Gelatin | 0.72 g/m² |

Gelatin hardening agent H-1 and a surface active agent were added to the layers in addition to the above compositions.

Samples 201 to 204 obtained as described above were processed following the same procedures as in (1) to (4) in Example-1-(3) except for development, and developed as described below.

| Step of Development (38° C.) | Time |
|---|---|
| Color Development | 3 min. 15 sec. |
| Bleaching | 6 min. 30 sec. |
| Washing | 2 min. 10 sec. |
| Fixing | 4 min. 20 sec. |
| Washing | 3 min. 15 sec. |
| Stabilizing | 1 min. 05 sec. |

The compositions of processing solutions used in the above steps were as follows.

| | |
|---|---|
| Color Developer: | |
| Diethylenetriaminepentaacetic Acid | 1.0 g |
| 1-hydroxyethylidene-1,1-Diphosphonic Acid | 2.0 g |
| Sodium Sulfite | 4.0 g |
| Potassium Carbonate | 30.0 g |
| Potassium Bromide | 1.4 g |
| Potassium Iodide | 1.3 ml |
| Hydroxyamine Sulfate | 2.4 g |
| 4-(N—ethyl-N—β-hydroxyethylamino)-2-methylaniline Sulfate | 4.5 g |
| Water to make | 1.0 liter |
| | pH 10.0 |
| Bleaching Solution: | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH 6.0 |
| Fixing Solution: | |
| Disodium Ethylenediaminetetraacetate | 1.0 g |
| Sodium Sulfite | 4.0 g |
| Aqueous Ammonium Thiosulfate Solution (70%) | 175.0 ml |
| Sodium Bisulfite | 4.6 g |
| Water to make | 1.0 |
| | pH 6.6 liter |
| Stabilizing Solution: | |
| Formalin (40%) | 2.0 ml |
| Polyoxyethylene-p-monononylphenylether (mean polymerization degree: 10) | 0.3 g |
| Water to make | 1.0 liter |

Color negative sensitivities of the 3rd green-sensitive layer and the 3rd blue-sensitive layer were estimated on the basis of a relative exposure amount for giving density larger by 0.1 than a minimum density of magenta and yellow densities. As a result, as in Example-1-(3), samples 203 and 204 had higher sensitivity, smaller low-intensity reciprocity failure, smaller sensitization and latent image fading upon incubation, and less stress marks than those of comparative samples 201 and 202. That is, the advantages of this invention are notable.

Structures of the compounds used in Examples 1 to 3 were shown in Table 5.

Following the same procedures as in Example-1-(3), coated samples 5 to 14 listed in Table 2 were prepared using emulsions C to G and 3 to 7, respectively. Following the same procedures as in (2) and (4) described in Example-1-(3), resistance to incubation and resistance to pressure were evaluated.

Results of resistance to incubation are shown in Table 2. As is apparent from Table 2, an advantage of this invention is significant for the tubular emulsions having mean grain diameter/thickness ratios of 4 to 10. As for resistance to pressure, almost no stress marks were generated in samples 10 to 13, but some stress marks smaller than those in sample 9 were generated in sample 14.

TABLE 2

| Sample No. | Basic Formulation | Mean Grain Diameter/ Thickness Ratio | Emulsion No. | Resistance to Incubation 50° C. 30% | Resistance to Incubation 50° C. 80% | |
|---|---|---|---|---|---|---|
| 5 | Emulsion A | 4.5 | Emulsion C | 120 | 110 | Comparative Example |
| 6 | " | 6.1 | Emulsion D | 125 | 105 | Comparative Example |
| 7 | " | 7.9 | Emulsion E | 125 | 110 | Comparative Example |
| 8 | " | 10.0 | Emulsion F | 120 | 105 | Comparative Example |
| 9 | " | 20.0 | Emulsion G | 115 | 105 | Comparative Example |
| 10 | Emulsion 1 | 4.4 | Emulsion 3 | 105 | 105 | Present Invention |
| 11 | " | 6.3 | Emulsion 4 | 105 | 100 | Present Invention |
| 12 | " | 8.0 | Emulsion 5 | 105 | 105 | Present Invention |
| 13 | " | 9.8 | Emulsion 6 | 100 | 95 | Present Invention |
| 14 | " | 20.1 | Emulsion 7 | 90 | 80 | Present Invention |

Note:
values in a column of resistance to incubation are sensitivities which are represented assuming that sensitivity of a control sample for test of resistance to incubation is 100 for each kind of sample.

EXAMPLE 4

(1) Preparation of Emulsion

In preparation of emulsion A described in Example-1-(1), an amount of potassium bromide in a vessel before silver nitrate was added, an amount of gelatin, a temperature, and an addition time of addition (I) were controlled, thereby preparing comparative emulsions C to G containing tabular AgBrI (AgI=2.0 mol%) grains, wherein various mean grain diameter/thickness ratios were as shown in Table 2 and a sphere corresponding diameter was about 0.8μ.

In preparation of emulsion 1 described in Example-1-(1), the parameters described above were controlled thereby preparing emulsions 3 to 7 of the invention containing tabular AgBrI (AgI=2.0 mol%) grains, wherein various mean grain diameter/thickness ratios were as shown in Table 2 and a sphere corresponding diameter was about 0.8μ. Emulsions C to G and 3 to 7 obtained as described above were mono-dispersed hexagonal tabular emulsions wherein variation coefficients of a grain size distribution was 15% or less.

(2) Observation of Dislocations in Grains

Following the same procedures as in Example-1-(2), dislocations in grains in the above emulsions were observed. As a result, similar to emulsion A, 90% or more of grains of emulsions C to G had no clear dislocations.

Emulsions 3 to 7 had dislocations similar to those of emulsion 1. In this case, 80% or more of the total of grains contained 10 or more dislocations.

(3) Preparation and Evaluation of Coated Samples

EXAMPLE 5

(1) Preparation of Emulsion

An aqueous solution was obtained by dissolving 6 g of potassium bromide and 30 g of inactive gelatin in 3.7 liter of distilled water. A 14% aqueous potassium bromide solution and a 20% aqueous silver nitrate solution were added to the above aqueous solution by a double jet method at constant flow rates over one minute under the conditions of 55° C. and a pBr of 1.0 while the above solution was agitated well (in this addition (I), 2.40% of a total silver amount was consumed). Then, an aqueous gelatin solution (17%, 300 cc) was added and agitated at 55° C., and a 20% aqueous silver nitrate solution was added at a constant flow rate until the pBr reached 1.40 (in this addition (II), 5.0% of the total silver amount was consumed). A 20% aqueous potassium bromide solution and a 33% aqueous silver nitrate solution were added by the double jet method over 43 minutes (in this addition (III), 49.6% of the total silver amount was consumed). During the addition, a temperature and a pBr were maintained at 55° C. and 1.50, respectively. 0.7 m mol/Ag mol of sodium anhydro-5-chloro-9-ethyl-5'-phenyl-3,3'-di(3-sulfopropyl)oxacarbocyaninehydroxide was added and adsorbed. Then, a solution containing 8.3 g of potassium iodide and a 33% aqueous silver nitrate solution were added by the double jet method over two minutes (in this addition (IV), 2.0% of the total silver amount was consumed).

Then, the resultant material was washed until the above composition lost site directivity, and the pBr was returned to 1.50. Aqueous potassium bromide and aqueous silver nitrate solutions having the same concentrations as in addition (III) were added by the double jet method over 26.3 minutes (in this addition (V), 31.0% of the total silver amount was consumed). During the addition, a temperature and a pBr were maintained at 55° C. and 1.50, respectively. An amount of silver nitrate used in this emulsion was 425 g. Desalting and after-ripening were performed following the same procedures as for emulsion A described in Example-1-(1), thereby preparing tabular AgBrI (AgI=2.0 mol%) emulsion 8 of this invention having a mean grain diameter/thickness ratio of 6.0 and a sphere equivalent diameter of 0.8μ.

Tabular AgBrI (AgI=2.0 mol%) emulsion 9 of this invention having a mean grain diameter/thickness ratio of 7.0 and a sphere equivalent diameter of 0.9μ was prepared following the same procedures as for emulsion 7 except that sodium 5,5',6,6'-tetrachloro-1,1'-diethyl-3,3'-di(3-sulfopropyl)-imidacarbocyanine was used as the site director and a pH was set to be 3.0 instead of washing in order to remove this director after addition (IV).

Emulsion 10 of this invention having a mean grain diameter/thickness ratio of 5.0 and a sphere-equivalent diameter of 0.8μ was prepared following the same procedures as for emulsion 7 except that 3-carboxymethyl-5-{2-(3-ethyl-2(3H)-thiazolinidene)ethylidene}rhodanine was used as the site director and 0.7 m mol/Ag mol of $H_2O_2$ was added instead of washing in order to remove this director after addition (IV).

An aqueous solution was obtained by dissolving 6 g of potassium bromide and 30 g of inactive gelatin in 2 liter of distilled water. Then, a 14% aqueous potassium bromide solution containing potassium iodide in an amount of a gram and a 20% aqueous silver nitrate solution were added to the above aqueous solution by the double jet method at constant flow rates over a predetermined time under the conditions of 55° C. and a predetermined pBr (in this addition (I'), 5.0% of the total silver amount was consumed). An aqueous gelatin solution (17%, 300 cc) was added at 55° C. and the resultant was agitated. Then, a solution containing potassium iodide in an amount of b gram and a 20% aqueous silver nitrate solution were added at constant flow rates until the pBr reached a predetermined value (in this addition (II'), 10.0% of the total silver amount was consumed). A 20% aqueous potassium bromide solution containing potassium iodide in an amount for adding c gram of potassium iodide and a 33% aqueous silver nitrate solution were added by the double jet method, thereby preparing core grains (in this addition (III'), 35% of the total silver amount was consumed). During the addition, a temperature and a pBr were maintained at 55° C. and a predetermined value, respectively. A solution containing d gram of potassium iodide was added over one minute. Then, a 20% aqueous potassium bromide solution containing potassium iodide in an amount for adding e gram of potassium iodide and a 33% aqueous silver nitrate solution were added by the double jet method to form shell on the core grain (in this addition (IV'), 50% of the total silver amount was consumed). During the addition, a temperature and a pBr were maintained at 55° C. and a predetermined value. A silver nitrate amount used in this emulsion was 425 g. Thereafter, desalting and after-ripening were performed following the same procedures as for emulsion A in Example-1-(1). In this formulation method, amounts of potassium iodide, a to e, were changed and an addition time and the pBr were controlled, thereby preparing comparative emulsion H containing tabular AgBrI (AgI=8 mol%) grains, wherein a mean sphere-equivalent diameter was 0.7μ, and emulsions 11 to 13 of this invention listed in Table 3.

TABLE 3

| Emulsion No. | Iodide Content of Core (a + b + c: mol %) | Iodide Content of Intermediate Portion (d: mol % total silver) | Iodide Content of Shell (e: mol %) | Mean Grain Diameter/ Thickness Ratio |
|---|---|---|---|---|
| Emulsion H | 8 | 0 | 8 | 5.5 |
| Emulsion 11 | 5 | 3 | 5 | 5.7 |
| Emulsion 12 | 1 | 3 | 9 | 5.8 |
| Emulsion 13 | 9 | 3 | 1 | 5.4 |

Emulsion 14 of this invention containing tubular AgBrI (AgI=2 mol%) grains, wherein a mean grain diameter/thickness ratio was 5.0 and a sphere equivalent diameter of 0.8μ, was prepared following the same procedures as for emulsion 1 described in Example-1-(1) except that a solution containing 1.5 g of KSCN was added immediately before addition (III).

Emulsion 15 of this invention containing tabular AgBrI (AgI=2 mol%) grains, wherein a mean grain diameter/thickness ratio was 7.5 and a sphere equivalent diameter was 0.8μ, was prepared following the same procedures as for emulsion 2 described in Example-1-(1) except that addition (III) was acceleratedly performed over 40 minutes so that a flow rate at the end is three times as large as the flow rate at the start.

Emulsion 16 of this invention containing tabular AgBrI (AgI=2.0 mol%) grains, wherein a mean grain diameter/thickness ratio was 6.3 and a sphere equivalent diameter was 0.8μ, was prepared following the same procedures as for emulsion 1 described in Example-1-(1) except that when 95% of the total silver amount was consumed during addition (III), addition of the silver nitrate and potassium bromide solutions were temporarily stopped and the solution containing 8.3 g of potassium iodide was added.

(2) Observation of Dislocations in Grains

Following the same procedures as in Example-1-(2), dislocations in grains in the above emulsions were observed. As a result, similar to emulsion A, 60% or more of the total of grains of emulsion H had no clear dislocations. Emulsions 8 to 15 had dislocations similar to those of emulsion 1. In this case, 50% or more of the total of grains of emulsions 8 to 15 had 10 or more dislocations. Emulsion 16 had dislocations at a position immediately close to an edge of tabular (i.e., outside a position separated away from the center by a distance which is 98% of a length between the center and the edge).

(3) Preparation and Evaluation of Coated Samples

Following the same procedures as in Example-1-(3), coated samples 15 to 24 were prepared as listed in Table 4. Then, following the same procedures as in Example-1-(3), coated samples 15 to 24 together with coated samples 1, 2, and 3 obtained in Example-1-(1) were evaluated.

TABLE 4

| Sample No. | Used Emulsion No. | |
|---|---|---|
| Sample 15 | Emulsion 8 | Present Invention |
| Sample 16 | Emulsion 9 | " |
| Sample 17 | Emulsion 10 | " |
| Sample 18 | Emulsion H | Comparative Example |
| Sample 19 | Emulsion 11 | Present Invention |
| Sample 20 | Emulsion 12 | " |
| Sample 21 | Emulsion 13 | " |
| Sample 22 | Emulsion 14 | " |
| Sample 23 | Emulsion 15 | " |
| Sample 24 | Emulsion 16 | " |

As a result, it was shown that as compared with coated sample 1, an advantage of this invention was significant in coated samples 15 to 17, 22 and 23 as in Example-1-(3). That is, coated samples 15 to 17, 22 and 23 had excellent storage stability, exposure intensity dependency, resistance to pressure, and the like.

In addition, as compared with coated sample 18, an advantage of this invention was significant in coated samples 19 to 21 of this invention.

The characteristics of coated sample 24 were intermediate between those of coated samples 2 and 3, and were closer to those of coated sample 2.

EXAMPLE 6

Comparative emulsion J containing tabular AgBrI (AgI=4.0 mol%) grains, wherein a mean grain diameter/thickness ratio was 7.0 and a sphere equivalent diameter was 0.3μ, was prepared following the same procedures as for emulsion A described in Example-1-(1) except that a temperature during grain formation was 40° C., addition (I) was performed over 30", and as the halide solution of addition (III), a 20% aqueous potassium bromide solution containing 16.6 g of potassium iodide was used.

Emulsion 17 of this invention containing tabular AgBrI (AgI=4.0 mol%) grains, wherein a mean grain diameter/thickness ratio was 6.5 and a sphere equivalent diameter was 0.3μ, was prepared following the same procedures as for emulsion J except that potassium iodide was removed from the halide solution used in addition (III), and when 50% of the total silver amount was consumed during addition (III), addition of the silver nitrate and potassium bromide solutions were temporarily stopped and the solution containing 16.6 g of potassium iodide was added.

A multilayer color light-sensitive material comprising layers having the following compositions was formed on an undercoated triacetylcellulose film support thereby preparing samples 301 and 302 containing emulsion J or 17 in their 1st red-sensitive, 1st green-sensitive, and 1st blue-sensitive layers.

| | |
|---|---|
| Layer 1: Antihalation Layer: | |
| Gelatin Layer (dry film thickness: 2μ) containing | |
| Black Colloid Silver | 0.25 g/m² |
| Ultraviolet Absorbent U-1 | 0.04 g/m² |
| Ultraviolet Absorbent U-2 | 0.1 g/m² |
| Ultraviolet Absorbent U-3 | 0.1 g/m² |
| High Boiling Organic Solvent O-1 | 0.1 cc/m² |
| Layer 2: Interlayer: | |
| Gelatin layer (dry film thickness: 1μ) containing | |
| Compound H-1 | 0.05 g/m² |
| High Boiling Organic Solvent O-2 | 0.05 cc/m² |
| Layer 3: 1st Red-sensitive Emulsion Layer: | |
| Gelatin Layer (dry film thickness: 1μ) containing | |
| Silver Iodobromide Emulsion (emulsion J or 17) Spectrally Sensitized with Sensitizing Dyes S-1 and S-2 | |
| silver | 0.5 g/m² |
| Coupler C-1 | 0.2 g/m² |
| Coupler C-2 | 0.05 g/m² |
| High Boiling Organic Solvent O-2 | 0.12 cc/m² |
| Layer 4: 2nd Red-sensitive Emulsion Layer: | |
| Gelatin Layer (dry film thickness: 2.5μ) containing | |
| Silver Iodobromide Emulsion (mono-dispersed cubic grains having an iodide content of 3.0 mol % and a mean grain size of 0.6μ) Spectrally Sensitized with Sensitizing Dyes S-1 and S-2 | |
| silver | 0.8 g/m² |
| Coupler C-1 | 0.55 g/m² |
| Coupler C-2 | 0.14 g/m² |
| High Boiling Organic Solvent O-1 | 0.33 cc/m² |
| Layer 5: Interlayer: | |
| Gelatin Layer (dry film thickness: 1μ) containing | |
| Compound H-1 | 0.1 g/m² |
| High Boiling Organic Solvent O-2 | 0.1 cc/m² |
| Layer 6: 1st Green-sensitive Emulsion Layer: | |
| Gelatin Layer (dry film thickness: 1μ) containing | |
| Silver Iodobromide Emulsion (same as the emulsion 1st red-sensitive layer) Spectrally Sensitized with Sensitizing Dyes S-3 and S-4 | |
| silver | 0.7 g/m² |
| Coupler C-3 | 0.35 g/m² |
| High Boiling Organic Solvent O-2 | 0.26 cc/m² |
| Layer 7: 2nd Green-sensitive Emulsion Layer: | |
| Gelatin Layer (dry film thickness: 2.5μ) containing | |
| Silver Iodobromide Emulsion (mono-dispersed cubic grains having an iodide content of 2.0 mol % and a mean grain size of 0.6μ) Spectrally Sensitized with Sensitizing Dyes S-3 and S-4 | |
| silver | 0.7 g/m² |
| Coupler C-4 | 0.25 g/m² |
| High Boiling Organic Solvent O-2 | 0.05 cc/m² |
| Layer 8: Interlayer: | |
| Gelatin Layer (dry film thickness: 1μ) containing | |
| Compound H-1 | 0.05 g/m² |
| High Boiling Organic Solvent O-2 | 0.1 cc/m² |
| Layer 9: Yellow Filter Layer: | |
| Gelatin Layer (dry film thickness: 1μ) containing | |
| Yellow Colloid Silver | 0.1 g/m² |
| Compound H-1 | 0.02 g/m² |
| Compound H-2 | 0.03 g/m² |
| High Boiling Organic Solvent O-2 | 0.04 cc/m² |
| Layer 10: 1st Blue-sensitive Emulsion Layer: | |
| Gelatin Layer (dry film thickness: 1.5μ) containing | |
| Silver Iodobromide Emulsion (same as the emulsion 1st red-sensitive layer) Spectrally | |

-continued

| | |
|---|---|
| Sensitized with Sensitizing Dye S 5 | |
| silver | 0.6 g/m² |
| Coupler C-5 | 0.5 g/m² |
| High Boiling Organic Solvent O-2 | 0.1 g/m² |
| Layer 11: 2nd Blue-sensitive Emulsion Layer: | |
| Gelatin Layer (dry film thickness: 3μ) containing | |
| Silver Iodobromide Emulsion (mono-dispersed cubic grains having an iodide content of 1.5 mol % and a mean grain size of 0.6μ) Spectrally Sensitized with Sensitizing Dye S-5 | |
| silver | 1.1 g/m² |
| Coupler C-5 | 1.2 g/m² |
| High Boiling Organic Solvent O-2 | 0.23 cc/m² |
| Layer 12: 1st Protective Layer: | |
| Gelatin Layer (dry film thickness: 2μ) containing | |
| Ultraviolet Absorbent U-1 | 0.02 g/m² |
| Ultraviolet Absorbent U-2 | 0.03 g/m² |
| Ultraviolet Absorbent U-3 | 0.03 g/m² |
| Ultraviolet Absorbent U-4 | 0.29 g/m² |
| High Boiling Organic Solvent O-1 | 0.28 cc/m² |
| Layer 13: 2nd Protective Layer: | |
| Gelatin Layer (dry film thickness: 0.8μ) containing | |
| Surface-fogged Fine Silver Iodobromide Grain Emulsion (iodide content: 1 mol %, mean grain size: 0.06μ) | |
| silver | 0.1 g/m² |
| Polymethylmethacrylate Grains (mean grain size: 1.5μ) | |

Gelatin hardening agent H-3 and a surface active agent were added to the layers in addition to the above compositions.

Samples 301 and 302 obtained as described above were processed following the same procedures as in 1 to 4 in Example-1-(3) except for development, and developed as described below.

Process Steps:

| Step | Time | Temperature |
|---|---|---|
| 1st Development | 6 min. | 38° C. |
| Washing | 2 min. | 38° C. |
| Reversal Development | 2 min. | 38° C. |
| Color Development | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Stabilizing | 1 min. | Room Temperature |
| Drying | | |

The compositions of processing solutions were as follows.

| | |
|---|---|
| 1st Developer: | |
| Water | 700 ml |
| Pentasodium Nitrilo-N,N,N—trimethylenephosphonate | 2 g |
| Sodium Sulfite | 20 g |
| Hydroquinone Monosulfonate | 30 g |
| Sodium Carbonate (Monohydrate) | 30 g |
| 1-phenyl-4-methyl-4-hydroxymethyl-3-pyrazolidone | 2 g |
| Potassium Bromide | 2.5 g |
| Potassium Thiocyanic Acid | 1.2 g |
| Potassium Iodide (0.1% solution) | 2 ml |

-continued

| | |
|---|---|
| Water to make | 700 ml |
| Reversal Bath: | |
| Water | 700 ml |
| Pentasodium Nitrilo-N,N,N—trimethylenephosphonate | 3 g |
| Stannous Choride (Dihydrate) | 1 g |
| p-aminophenol | 0.1 g |
| Sodium Hydroxide | 8 g |
| Glacial Acetic Acid | 15 ml |
| Water to make | 1,000 ml |
| Color Developer: | |
| Water | 700 ml |
| Pentasodium Nitrilo-N,N,N—trimethylenephosphonate | 3 g |
| Sodium Sulfite | 7 g |
| Tribasic Sodium Phosphate (Dodecahydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—ethyl-N—(β-methanesulfonamido-ethyl)3-methyl-4-aminoaniline Sulfate | 11 g |
| 3,6-dithiaoctane 1,8-diode | 1 g |
| Water to make | 1,000 ml |
| Conditioning Solution: | |
| Water | 700 ml |
| Sodium Sulfite | 12 g |
| Sodium Ethylenediaminetetraacetate (dihydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate (Dihydrate) | 2 g |
| Ferric (III) Ammonium Ethylenediaminetetraacetate (Dihydrate) | 120 g |
| Potassium Bromide | 100 g |
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formalin (37 wt %) | 5.0 ml |
| Fuji Driwel (surface active agent available from Fuji Photo Film Co., Ltd.) | 5.0 ml |
| Water to make | 1,000 ml |

Color negative sensitivities of the 1st red-sensitive layer, the 1st green-sensitive layer and the 3re blue-sensitive layer were estimated on the basis of a relative exposure amount for giving density larger by 0.5 than a minimum density of cyan, magenta and yellow densities.

As a result, it was shown that as in Example-1-(3), coated sample 302 containing emulsion 17 of this invention had better storage stability, exposure intensity dependency, and resistance to pressure than those of coated sample 301 containing comparative emulsion J. As for resistance to pressure, reductions in cyan, magenta, and yellow densities of a pressurized portion at the low density side were small in sample 302 while they were large in sample 301.

The structures of compounds used in Example 6 are shown in Table 6.

TABLE 5
C-1
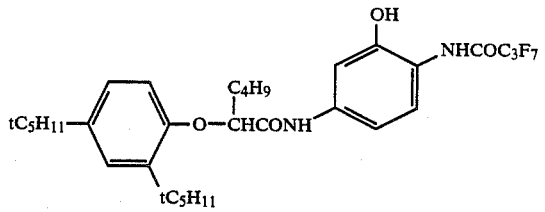
C-2
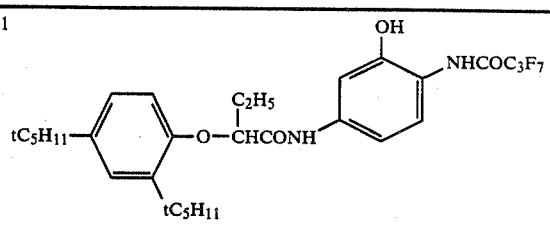
C-3
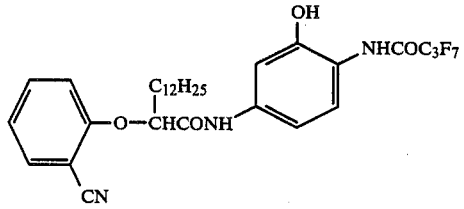
C-4
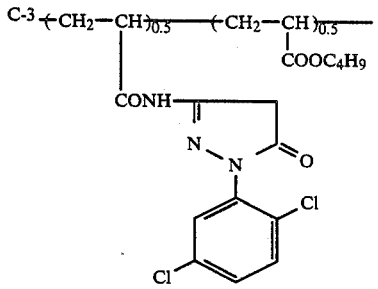
C-5
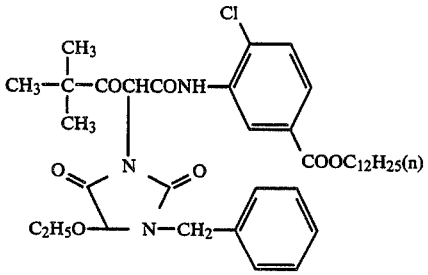
C-6
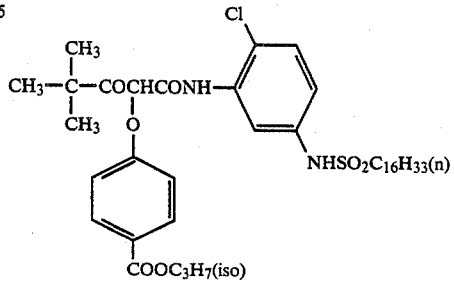
C-11
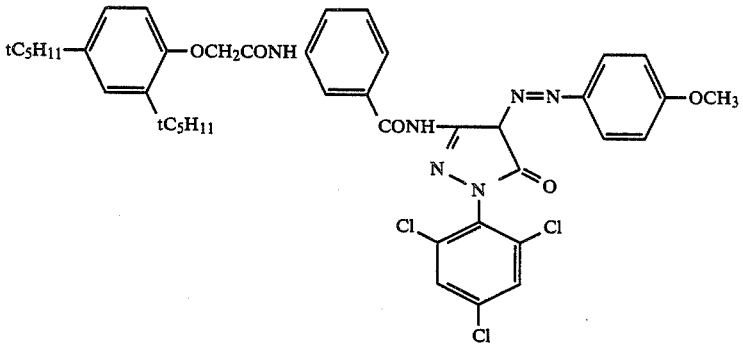
C-12
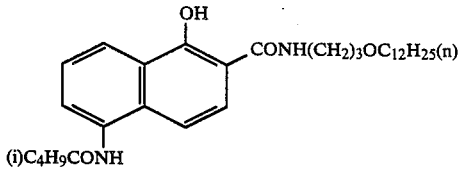
C-13
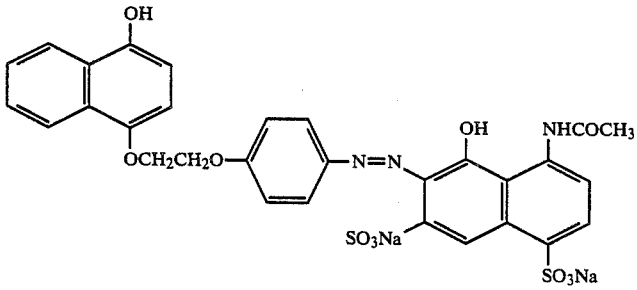

TABLE 5-continued
C-14
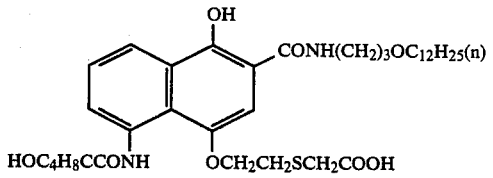
C-15
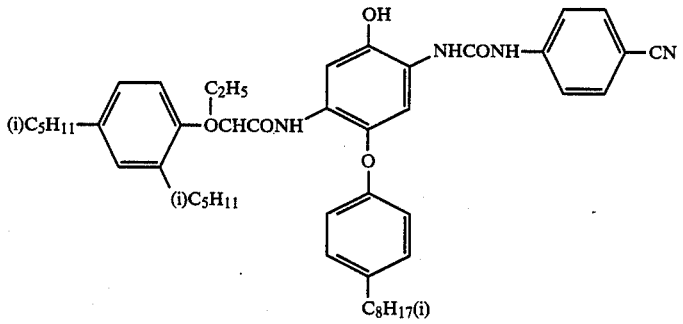
C-16
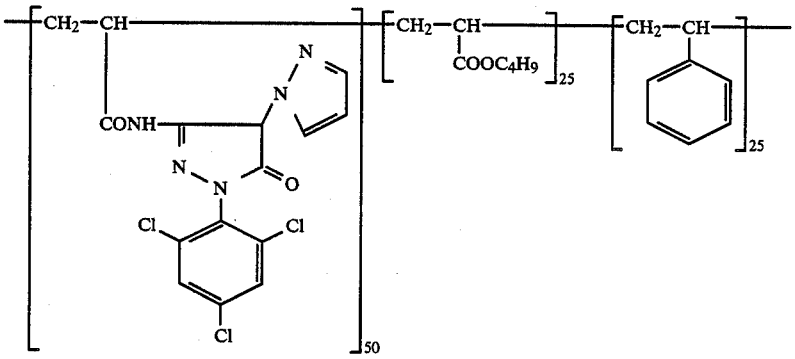
mean molecular weight 30,000
C-17
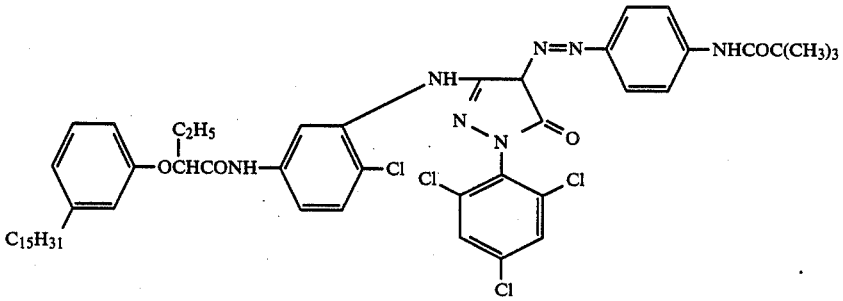
C-18
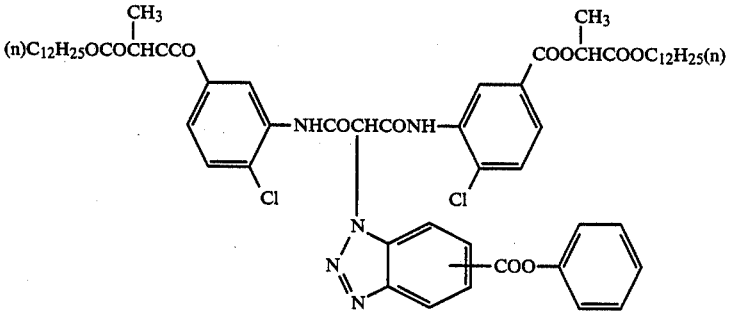

TABLE 5-continued
C-19
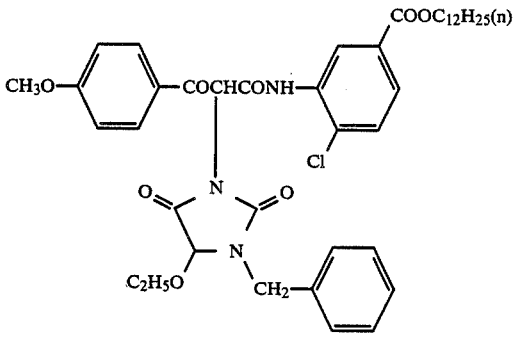
C-20
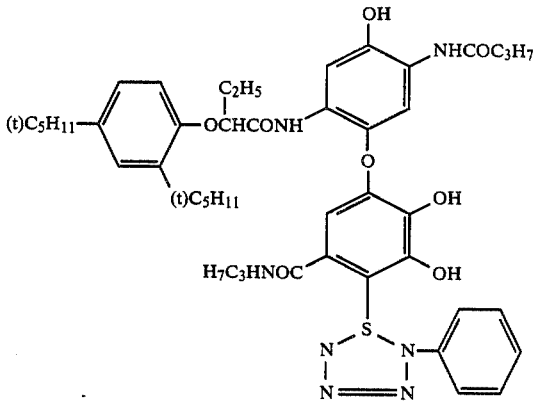
S-1
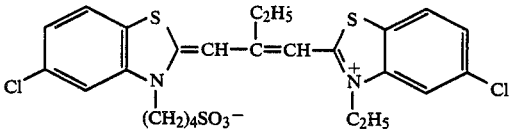
S-2
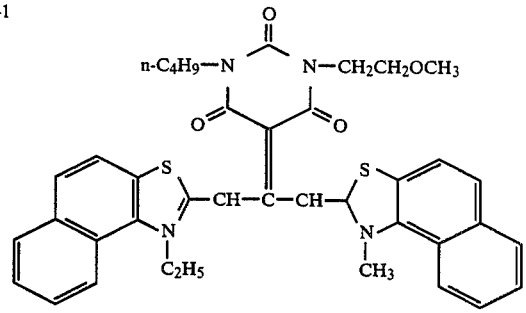
S-3
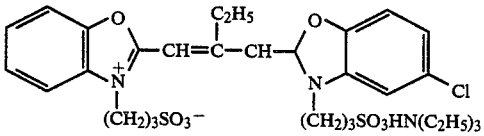
S-4
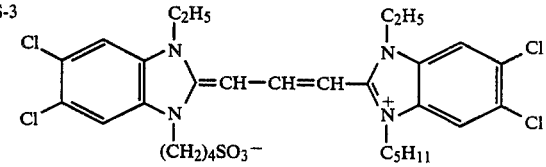
S-5
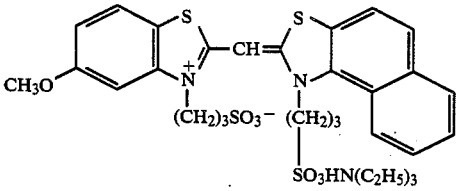
S-6
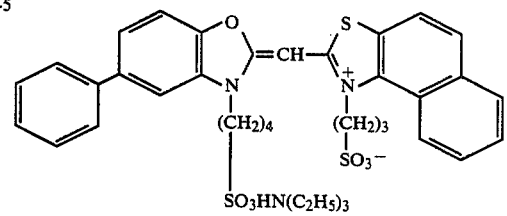
S-11
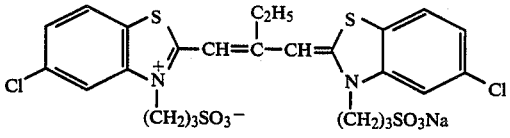
S-12
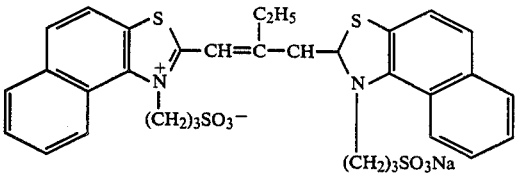
S-13
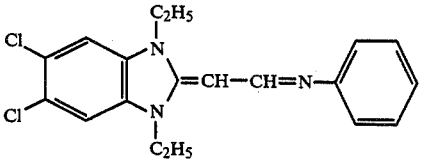
S-14
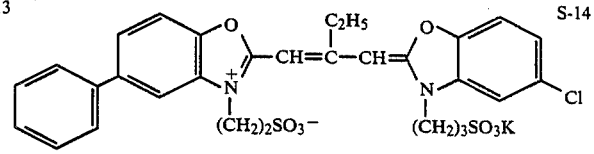

TABLE 5-continued
S-15
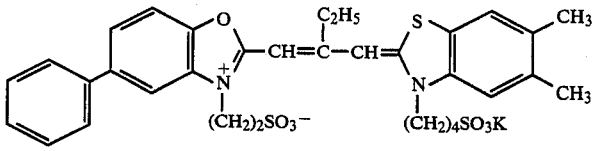
S-16
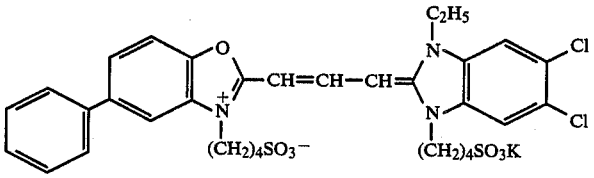
S-17
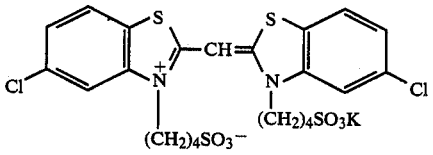
S-18
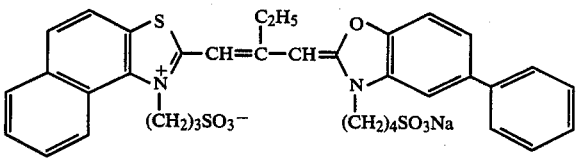
U-1
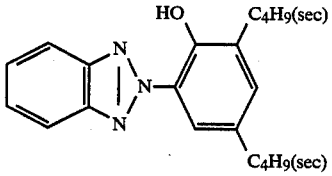
U-2
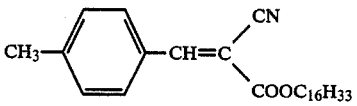
U-3
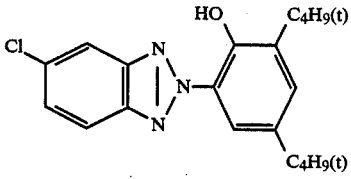
U-4
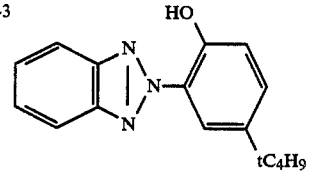
U-5
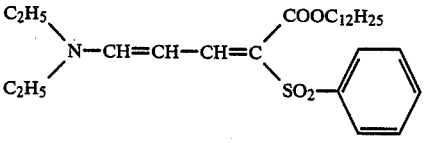
U-6
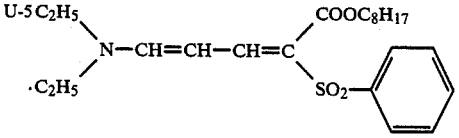
U-11
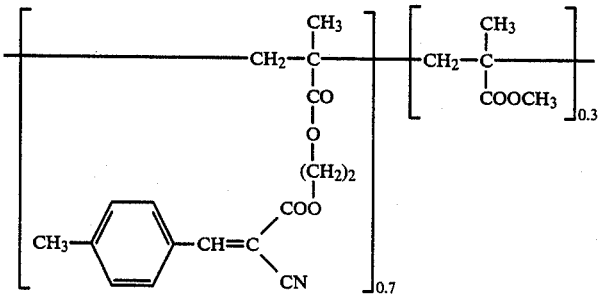

TABLE 5-continued
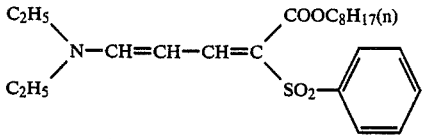
U-12
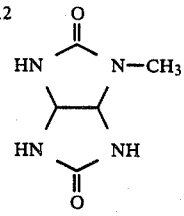
U-13
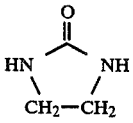
U-14 Oil 1 dibutyl phtalate
Oil 2 tricresyl phosphate
Oil 3 $C_2H_5$
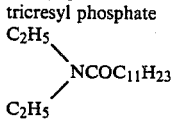
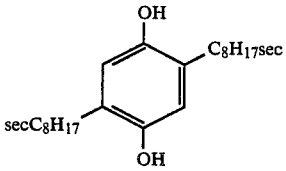
Cpd A
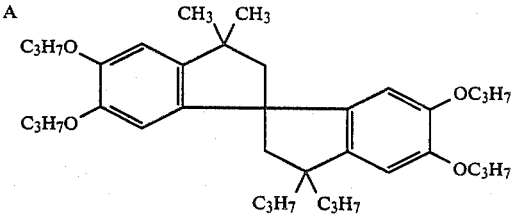
Cpd B
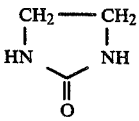
Cpd C
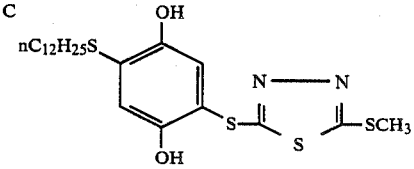
Cpd D
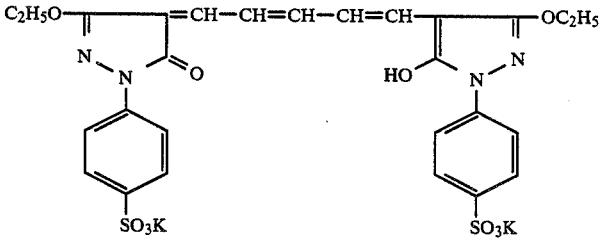
D-1
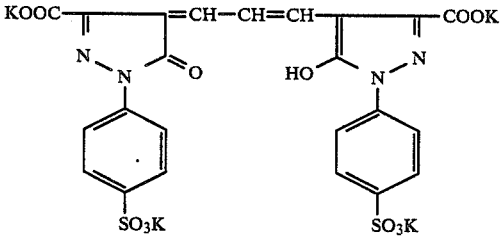
D-2
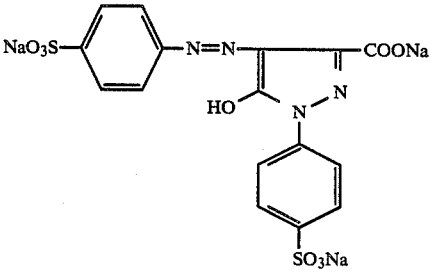
D-3 $CH_2{=}CHSO_2CH_2CONHCH_2$
$CH_2{=}CHSO_2CH_2CONHCH_2$
H-1

TABLE 5-continued
W-1
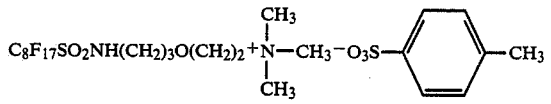
TABLE 6
C-1
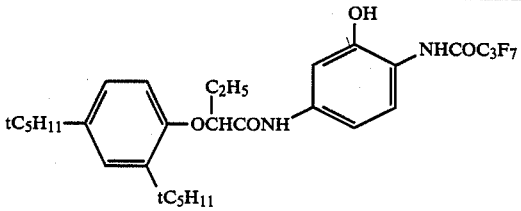
C-2
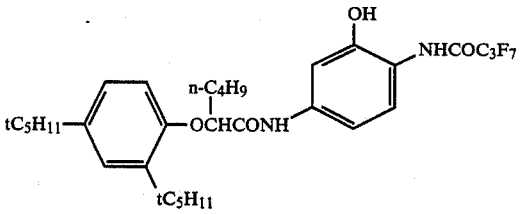
C-3
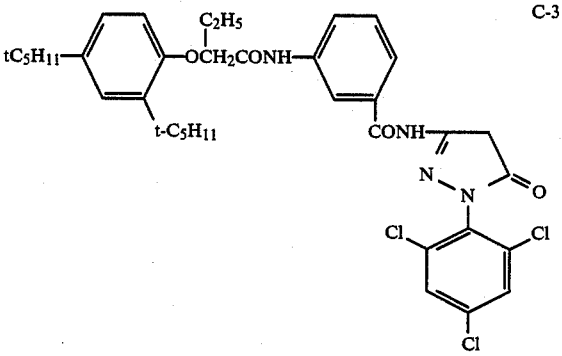
C-4
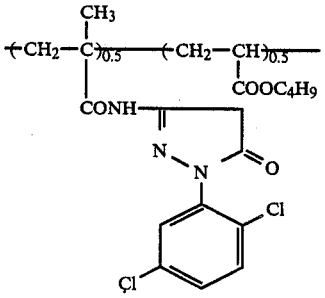
C-5
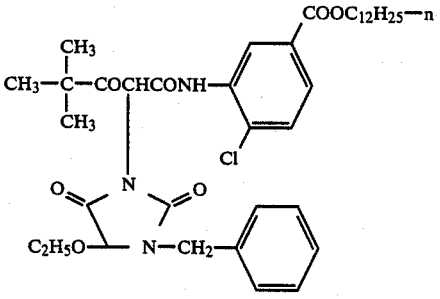
TABLE 6-continued
S-1
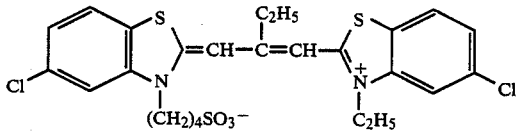
S-2
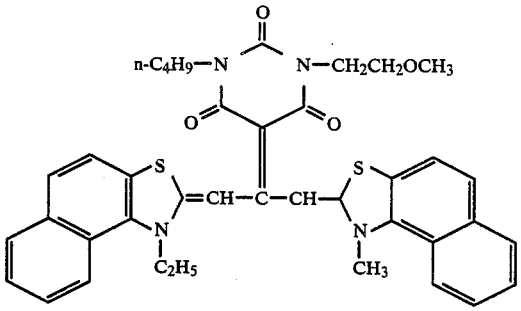
S-3
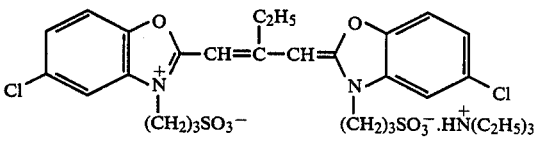
S-4
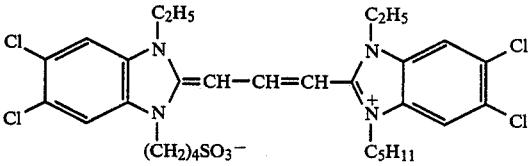
S-5
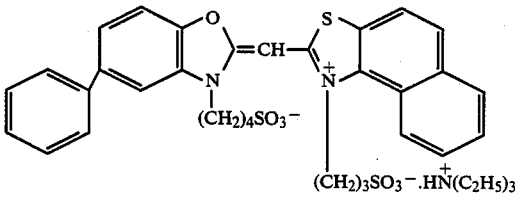
U-1
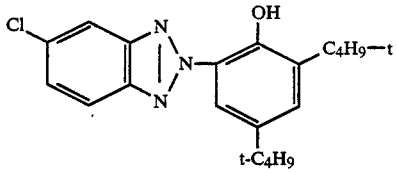
U-2
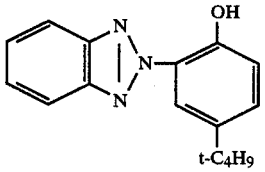

TABLE 6-continued

U-3

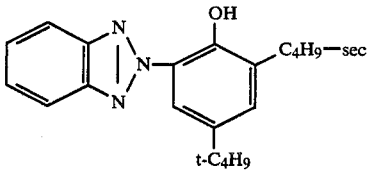

U-4

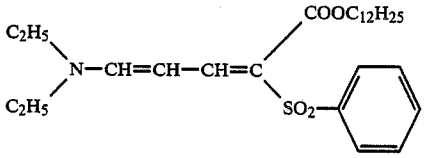

H-1

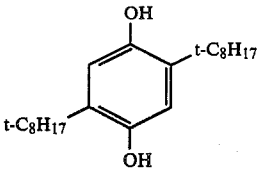

H-2

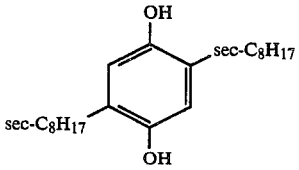

H-3

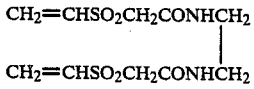

TABLE 6-continued

O-1

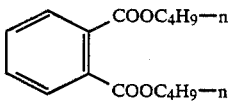

O-2

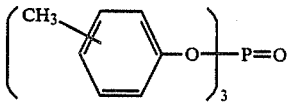

What is claimed is:

1. A silver halide emulsion comprising a dispersion medium and silver halide grains, the silver halide emulsion containing tabular silver halide grains having a thickness of 0.5 μm or less, a diameter of 0.3 μm or more, and a mean diameter-to-thickness ratio of 2 or more, wherein said tabular grains occupy at least 50% of a projected area of all the silver halide grains, and 50% (number) or more of said tabular grains include 10 or more dislocations per grain.

2. The emulsion as in claim 1, wherein the tabular grain has an inner region portion having a higher silver iodide content than that of a surface region of the tabular grain.

3. A photographic light-sensitive material comprising a support having thereon at least one silver halide emulsion layer, wherein the silver halide emulsion layer contains a silver halide emulsion comprising a dispersion medium and silver halide grains, the silver halide emulsion containing tabular silver halide grains having a thickness of 0.5 μm or less, a diameter of 0.3 μm or more, and a mean diameter-to-thickness ratio of 2 or more, wherein said tabular grains occupy at least 50% of a projected area of all the silver halide grains, and 50% (number) or more of said tabular grains include 10 or more dislocations per grain.

4. The material as in claim 3, wherein the tabular grain has an inner region portion having a higher silver iodide content than that of a surface region of the tabular grain.

* * * * *